US006193788B1

(12) United States Patent
Nojima

(10) Patent No.: US 6,193,788 B1
(45) Date of Patent: Feb. 27, 2001

(54) ELECTRIC DUST COLLECTING APPARATUS AND MANUFACTURING METHOD OF THE SAME

(75) Inventor: Kouzaburou Nojima, Tokyo (JP)

(73) Assignee: Kabushiki Kaisya O-DEN, Tokyo (JP)

( * ) Notice: Subject to any disclaimer, the term of this patent is extended or adjusted under 35 U.S.C. 154(b) by 0 days.

(21) Appl. No.: 09/035,999

(22) Filed: Mar. 6, 1998

(30) Foreign Application Priority Data

Mar. 7, 1997 (JP) ..... 9-070493

(51) Int. Cl.[7] ..... B03C 3/40

(52) U.S. Cl. ..... 96/97; 29/34 R; 29/896.62; 96/100

(58) Field of Search ..... 96/97, 100, 69, 96/15; 264/241, 249, DIG. 48; 29/34 R, 896.62

(56) References Cited

U.S. PATENT DOCUMENTS

| | | | | |
|---|---|---|---|---|
| 2,505,907 | * | 5/1950 | Meston | 96/97 |
| 2,604,183 | | 7/1952 | Richardson | 96/85 |
| 3,144,881 | | 8/1964 | Sproull | 138/117 |
| 4,056,372 | * | 11/1977 | Hayashi | 96/97 X |
| 5,055,115 | * | 10/1991 | Yikai et al. | 96/97 X |
| 5,456,741 | * | 10/1995 | Takahara et al. | 96/97 X |
| 5,667,563 | * | 9/1997 | Silva, Jr. | 96/97 X |
| 5,667,564 | * | 9/1997 | Weinberg | 96/97 X |
| 5,707,429 | * | 1/1998 | Lewis | 96/97 X |
| 5,925,170 | * | 7/1999 | Nojima | 96/100 X |
| 5,950,424 | * | 9/1999 | Nojima | 96/15 X |
| 5,958,112 | * | 9/1999 | Nojima | 96/97 X |

FOREIGN PATENT DOCUMENTS

| | | | | |
|---|---|---|---|---|
| 2018447 | * | 11/1971 | (DE) | 96/97 |
| 2 031 704 | | 12/1971 | (DE) . | |
| 54-34676 | | 8/1952 | (JP) . | |
| 56-939 | | 1/1981 | (JP) . | |
| 58-116059 | | 8/1983 | (JP) . | |
| 61-107957 | | 5/1986 | (JP) . | |
| 2-40021 | | 3/1990 | (JP) . | |
| 4-27908 | | 5/1992 | (JP) . | |
| 6-92343 | | 4/1994 | (JP) . | |

OTHER PUBLICATIONS

Patent Abstracts of Japan, JP 3–161059, Jul. 11, 1991.

Patent Abstracts of Japan, JP 8–024709, Jan. 30, 1996.

* cited by examiner

*Primary Examiner*—Richard L. Chiesa
(74) *Attorney, Agent, or Firm*—Oblon, Spivak, McClelland, Maier & Neustadt, P.C.

(57) ABSTRACT

An electric dust collecting apparatus includes at least one needle electrode for charging floating particles in air by generating a corona discharge around needle points; at least one collecting electrode provided on cell-liked arrangement corresponding to the needle electrodes, for attracting and collecting the charged floating particles by an electrostatic force; and at least one deflection electrode having a rectangularly hollow longitudinal structure having a front plate portion and side plate portions wherein the needle electrodes are fixed on the front plate portion, for applying a deflection force to the charged floating particles to move toward the collecting electrodes by a potential applied from the side plate portions, and wherein the at least one deflection electrode having the rectangularly hollow longitudinal structure is obtained by bending a profile plate punched up a sheet metal by a predetermined punch press process, accordingly, the plurality of deflection electrodes can be integratedly formed from a profile punched up from a sheet metal by the punching and bending press process, enabling the manufacturing process to have workability and productivity.

19 Claims, 25 Drawing Sheets

ENLARGED VIEW
33
32
p
23
28
29
29a
29b
36
37

ELECTRIC DUST COLLECTING APPARATUS AND MANUFACTURING METHOD OF THE SAME

FIELD OF THE INVENTION

The present invention relates to an electric dust collecting apparatus and a manufacturing method of the same, and more particularly to an electric dust collecting apparatus and a manufacturing method of the same suitably used for such as an air cleaner, a black smoke removing apparatus for Diesel engine's exhaust and an oil-mist removing apparatus for use in a factory.

DISCUSSION OF THE BACKGROUND

Recently, buildings such as office buildings, restaurants, recreation facilities, factories, housings have substantially air-tight structures. Therefore, air stagnates in the buildings. Such air contains smoke floating in the air caused by tobacco, toner come out from a copy machine, particles of copy papers dust together with bad smell and often toxic substance therein. This impairs people in the buildings in health, and also makes the facilities and machines dirty. Due to this, the use of an electric dust collecting-type air cleaner has spread. Such cleaner is installed in the building to collect floating particles such as the smoke caused by tobacco and the toner, and remove offensive smells from the air.

Such air cleaner is shown in FIGS. 22 and 23. This air cleaner is of a wall-suspension type, and has a pre-filter 1, an electrostatic-type dust collecting unit 2, a deodorizing filter 3 made up of an active carbon fiber and the like, a fan 4 such as cross-flow fan and the like, and a power source (not shown).

In operation of the air cleaner, dirty air 5 containing, for example, floating particles such as the toner and the tobacco smoke is sucked into an inner portion of the air cleaner from a suction opening 6 near ceiling by a suction power of the fan 4. The dirty air 5 first passes through the pre-filter 1 to thereby lose relatively large ones of the floating particles. Subsequently, it flows into the dust collecting unit 2 where the floating particles are charged as a corona electrification and collected in electrostatically. Finally, the air flows into the deodorizing filter 3 to have its bad odors removed, and is then purified. The purified air 7 then blows toward a floor from a blowing opening 8 under the influence of a discharging power of fan 4. In the case of the air cleaner, the suction opening 6 is projected from a body of the air cleaner. Therefore, it is possible to circulate the air in a room effectively, so that the air is purified for a relatively short period of time.

Referring to FIGS. 24 to 26, the dust collecting unit 2 which is a major part of the air cleaner will now be described.

FIG. 24 is a vertical sectional view of the dust collector 2 shown in FIG. 26. FIG. 25 is a vertical sectional exploded view of the same dust collector 2 divided into two sub-units. FIG. 26 is a perspective view of the dust collector 2, illustrating a front side (i.e., air suction side) of the dust collector 2.

The dust collector 2 described above comprises a male sub-unit 11 having needle deflection electrodes 10 as a needle-attached prism structure arranged inside an outer casing-like frame 9; and, a female sub-unit 14 having collector cells (collector electrodes) 13 each assuming a rectangular pipe shape, wherein the shape has openings in its opposite ends, and the sub-unit 14 serves as an electrostatic dust collecting filter assuming a multiple grating shape, and is disposed inside an inner casing-like frame 12. With the frames 9 and 12 combined with each other, the collector cells 13 and corresponding needle deflection coupled electrodes 10 are oppositely disposed from each other. In other words, the needle deflection coupled electrode 10 is fixedly mounted in the corresponding collector cell 13, and spaced apart therefrom. It is noted that the male sub-unit 11 and the female sub-unit 14 are detachable from each other to facilitate cleaning work and the like thereof (see FIG. 25).

The needle deflection coupled electrode 10 is constructed of: a needle electrode 15 for generating an ionized space area to charge the floating particles passed therethrough; and, a prism-shaped deflection electrode (for example, approximately 10 mm square in cross-section, with a length of from 5 to 6 cm) 16 assuming a rectangular pipe-like shape having a front plate portion and a side plate portion, wherein the front plate portion fixedly supports the needle electrode 15, and deflects the floating particles (which have been charged by a potential of the side plate portion) to the collector cells 13. The needle deflection coupled electrodes 10 are connected with each other through metal coupling members 17 to have the same potential. On the other hand, these members 17 are supported by the outer casing-like frame 9 through insulating joint plates 18, 13 for electrically insulating the members 17 from the frame 9. It is noted that a high voltage (for example, 5 to 6 kV) is applied between the needle deflection coupled electrode 10 and the collector cell 13 during operation from a direct current high voltage power source (not shown) so that the needle deflection coupled electrode 10 has a positive potential while the collector cell 13 has a negative potential.

FIG. 27 is a schematic diagram illustrating the operation of the air cleaner. As described above in construction, when a direct current high voltage is applied to the needle deflection coupled electrode 10, a corona discharge occurs around a needle point of needle electrode 15 to form a continuous and stable ionized space area 19. At this time, the dirty air 5 sucked into the dust collecting unit 2 by the fan 4 passes through the ionized space area 19. In the area 19, oxygen having a low energy becomes first a positive ion. The positive ion then adheres to particles 20 in gases such as tobacco smoke to give a positive ion electric charge to the particles 20. When the particles 20 having the electric charge pass between a deflection electrode 16 and the collector cell 13, the particles 20 near the collector cell 13 adhere to the collector cell 13 having the negative potential. On the other hand, the particles 20 far apart from collector cell 13 are repelled by the deflection electrode 16 toward the collector cell 13 and then adhere thereto under the influence of the positive potential of the deflection electrode 16, so that the particles 20 having a micro-size of from 0.01 to 10 $\mu$m are collected effectively.

FIG. 28(*a*) is a perspective view of a pin member 150 assuming a record player's stylus-like shape and made of stainless steel, wherein the pin member 150 was used as the needle electrode 15. Also, the deflection electrode 16 is comprised of a pair of bent metal plate members 160. The member 160 has: a pair of side plate portions forming in cross-section a U-shaped groove; and, a front plate portion connecting the side plate portions to form a U-shaped form in plan view. As a result, the pair of bent metal plate members 160 form a rectangularly hollow longitudinal portion, as shown in FIG. 28(*b*).

Referring to FIG. 28(*b*), a proximal end of the pin member 150 is attached to an abutting portion of the front plate portion of the bent metal plate member 160, and then fixed thereto using a silver solder G to form the needle deflection coupled electrode 10. However, since the dust collector 2 has 50 to 200 pieces of the needle deflection coupled electrodes 10, much time and labor are required to produce the needle deflection coupled electrodes 10 with the use of the silver solder G. Consequently, the air cleaner is high in manufacturing cost and low in productivity. In addition, the needle electrode 15 is connected with the abutting portion of the front plate portion through a butt joint, which is unstable in operation to offer a disadvantage.

SUMMARY OF THE INVENTION

It is therefore an object of the present invention to provide an electric dust collecting apparatus and a manufacturing method for the same capable of reducing manufacturing cost and enhancing productivity, and also having a good impact resistance.

According to a first aspect of the present invention, there is provided an electric dust collecting apparatus including at least one needle electrode for charging floating particles in air by generating corona discharge around needle points; at least one collecting electrode provided on a cell-liked arrangement corresponding to the needle electrodes, for attracting and collecting the charged floating particles by electrostatic force; and at least one deflection electrode having a rectangularly hollow longitudinal structure comprising a front plate portion and side plate portions and fixing of the needle electrodes on the front plate portion, for applying a deflection force to the charged floating particles to move toward the collecting electrodes by a potential applied from the side plate portions, in which the at least one deflection electrode having the rectangularly hollow longitudinal structure is obtained from bending a profile plate punched up from a sheet metal by a predetermined punch press process.

According to a second aspect of the present invention, there is provided an electric dust collecting apparatus including a plurality of needle electrodes for charging floating particles in air by generating corona discharge around needle points; a plurality of cell-liked collecting electrodes provided in correspondence with the respective needle electrodes, for attracting and collecting the charged floating particles by electrostatic force; and a plurality of deflection electrodes each having a rectangularly hollow longitudinal structure comprised of a front plate portion and side plate portions and fixed the needle electrodes on the front plate portion, for applying a deflection force to the charged floating particles to move toward the collecting electrodes by a potential applied from the side plate portions, in which predetermined number of deflection electrodes is grouped into either several units or a single unit, each of the units has N (integer of 2 or greater) number of deflection electrodes each having the rectangularly hollow longitudinal structure coupled with a connecting portion therebetween, the rectangularly hollow longitudinal structures are obtained from a profile plate punched up from a sheet metal and bent to form the side plate portions and front plate potion by a punch press process, whereby the rectangularly hollow longitudinal structures are arranged with a three-dimensional integrated piece fabricated.

The N number of deflection electrodes each having the rectangularly hollow longitudinal structure in one unit may be coupled with the connecting portion therebetween, and the rectangularly hollow longitudinal structures may be obtained from the profile plate punched up the sheet metal and bent to form the side plate portions and front plate portion by the punch press process, thereby the rectangularly hollow longitudinal structures are arranged in series with the three-dimensional integrated piece fabricated.

The N number of deflection electrodes each having the rectangularly hollow longitudinal structure in one unit may be coupled with the connecting portion therebetween, and the rectangularly hollow longitudinal structures may be obtained from the profile plate punched up from the sheet metal and bent to form the side plate portions and front plate portion by the punch press process such that two connecting portions are opposite each other after bending, whereby the rectangularly hollow longitudinal structures having a predetermined interval are arranged in series with the three-dimensional integrated piece fabricated.

The needle electrodes may be arranged on substantially central positions on each of the front plates of the deflection electrodes in alignment.

The N number of deflection electrodes each having the rectangularly hollow longitudinal structure in one unit may be coupled with the connecting portion therebetween; the rectangularly hollow longitudinal structures may be obtained from the profile plate punched up the sheet metal and bent to form the side plate portions and front plate portion by the punch press process, whereby the rectangularly hollow longitudinal structures are arranged in series with the three-dimensional integrated piece fabricated; and M number of units having the N number of deflection electrodes are provided and coupled through the connecting portions, thus M (integer of 2 or greater) times N number of deflection electrodes are provided.

The N number of deflection electrodes each having the rectangularly hollow longitudinal structure in one unit may be coupled with the connecting portions therebetween; the rectangularly hollow longitudinal structures may be obtained from the profile plate punched up the sheet metal and bent to form the side plate portions and front plate portion by the punch press process, thereby the rectangularly hollow longitudinal structures are arranged in series with the three-dimensional integrated piece fabricated; and M number of units are provided and coupled through (M+1) number of connecting portions, thus M (integer of 2 or greater) times N number of deflection electrodes are provided.

The needle electrode having a needle portion and a body portion may be provided on each of the front plate portions of the deflection electrodes where a plurality of needle electrode mounting holes are open at a substantially central portion of the front plate portions, and each of the body portions may be engaged and tightly fixed to the needle electrode mounting hole with the needle electrode projected from the front plate portion.

The needle electrode having a needle portion and a relatively thin body portion and a relatively thick body portion in order may be fixedly mounted on each of the front plate portions of the deflection electrodes where needle electrode mounting holes open at a substantially central portion of the front plate portions in which each of the relatively thin body portions of the needle electrodes is inserted into the needle electrode mounting hole from an outside of the front plate portion and caulked from an inside of the front plate portion.

The needle electrode having a needle portion and a relatively thin body portion and a relatively thick body portion in order may be fixedly mounted on each of the front plate portions of the deflection electrodes where the needle electrode mounting holes open at a substantially central portion of the front plate portions in which each of the relatively thin body portions of the needle electrodes is inserted into the needle electrode mounting hole from an outside of the front plate portion and fixed to the front plate portion by a brazing joint.

According to a third aspect of the present invention, there is provided an electric dust collecting apparatus including a plurality of group electrodes each having a needle electrode for charging floating particles in air by generating corona discharge around needle points; a collecting electrode provided on cell-liked arrangement corresponding to the needle electrodes, for attracting and collecting the charged floating particles by electrostatic force; and a deflection electrode having a rectangularly hollow longitudinal structure comprised of a front plate portion and side plate portions and fixing the needle electrodes on the front plate portion, for applying a deflection force to the charged floating particles to move toward the collecting electrodes by a potential applied from the side plate portions, in which the needle electrode is made up of a stainless steel and a needle portion thereof is applied by a nickel plating of 2 to 10 $\mu$m thick.

The plurality of group electrodes may be integratedly provided and coupled with a pair of connecting portions and fixed the needle electrodes on the front plate portions of N number of deflection electrodes arranged in series; the bottom parts of the plurality of group electrodes may be mechanically and electrically coupled with a plurality of comb-type coupling members; and the plurality of comb-type coupling members may be mechanically and electrically engaged with the pair of connecting portions.

The plurality of group electrodes may be integratedly provided and coupled with a pair of connecting portions and fixed the needle electrodes on the front plate portions of N number of deflection electrodes arranged in series: and the plurality of group electrodes may be mechanically and electrically coupled by rod coupling members penetrated into coupling holes formed on the connecting portions with a predetermined interval opened, whereby the plurality of group electrodes are fixed by the rod coupling members in a complete piece.

According to a fourth aspect of the present invention, there is provided a method of manufacturing an electric dust collecting apparatus including al least one needle electrode for charging floating particles in air by generating corona discharge around needle points; at least one collecting electrode provided on cell-liked arrangement corresponding to the needle electrodes, for attracting and collecting the charged floating particles by electrostatic force; and at least one deflection electrode having a rectangularly hollow longitudinal structure comprised of a front plate portion and side plate portions and fixing the needle electrodes on the front plate portion, for applying a deflection force to the charged floating particles to move toward the collecting electrodes by a potential applied from the side plate portions, in which applying a punch press process to a sheet metal to obtain a profile plate of rectangularly hollow longitudinal structures; and bending the profile plate along in a longitudinal direction of the plate to form side plate portions and front plate portion made up of a rectangularly hollow longitudinal structure occur, thereby forming the at least one deflection electrode.

According to a fifth aspect of the present invention, there is provided a method of manufacturing an electric dust collecting apparatus including a plurality of needle electrodes for charging floating particles in air by generating corona discharge around needle points; a plurality of cell-liked collecting electrodes provided corresponding with the respective needle electrodes, for attracting and collecting the charged floating particles by electrostatic force; and a plurality of deflection electrodes each having a rectangularly hollow longitudinal structure comprised of a front plate portion and side plate portions and fixed the needle electrodes on the front plate portion, for applying a deflection force to the charged floating particles to move toward the collecting electrodes by a potential applied from the side plate portions, in which there occurs the steps of determining a predetermined number of deflection electrodes into either several units or a single unit, each of the units has N (integer of 2 or greater) number of deflection electrodes each having the rectangularly hollow longitudinal structure coupled with a connecting portion therebetween; punching a single metal plate to have a profile plate of the rectangularly hollow longitudinal structures are obtained from a profile plate punched up a sheet metal; and bending the profile plate to form the rectangularly hollow longitudinal structures each having the side plate portion and the front plate portion by a punch press process, whereby the rectangularly hollow longitudinal structures are arranged with a three-dimensional integrated piece fabricated.

The punching process applies to a sheet metal so as to have a profile plate of N number of rectangularly hollow longitudinal structures and bend the profile plate to form the rectangularly hollow longitudinal structures in series each having the side plate portion and the front plate portion coupled with the connecting portions therebetween by a punch press process, thereby N number of deflection electrodes each having the rectangularly hollow longitudinal structure in series are arranged with a three-dimensional integrated piece fabricated.

The punching process applies to a sheet metal to have a profile plate of N number of rectangularly hollow longitudinal structures and bend the profile plate to form the rectangularly hollow longitudinal structures in series, each having the side plate portion and the front plate portion coupled with the connecting potions therebetween by a punch press process, whereby the rectangularly hollow longitudinal structures are arranged in series with the three-dimensional integrated piece fabricated; and M number of units having the N number of deflection electrodes are provided and coupled through the connecting portions, thus M (integer of 2 or greater) times N number of the deflection electrodes are provided.

According to a sixth aspect of the present invention, there is provided a method of manufacturing an electric dust collecting apparatus including a plurality of needle electrodes for charging floating particles in air by generating corona discharge around needle points; a plurality of cell-liked collecting electrodes provided corresponding with the respective needle electrodes, for attracting and collecting the charged floating particles by electrostatic force; and a plurality of deflection electrodes each having a rectangularly hollow longitudinal structure comprised of a front plate portion and side plate portions and fixing the needle electrodes on the front plate portion, for applying a deflection force to the charged floating particles to move toward the collecting electrodes by a potential applied from the side plate portions, in which providing the needle electrodes each having a needle portion and a body portion; applying a punch press process to a sheet metal to have a profile of the deflection electrodes; providing needle electrode mounting holes, a diameter of which is smaller than that of the body portion, at a substantially central portion of the front plate portions; and inserting the needle electrodes into the needle electrode mounting holes by applying an impact to the needle electrodes from back of the front plate while bending the profile plate along in a longitudinal direction to form the deflection electrodes occur, whereby the needle portion of the needle electrode is projected from the front plate portion and the body portion of the needle electrode is tightly fixed on the needle electrode mounting holes.

According to a seventh aspect of the present invention, there is provided a method of manufacturing an electric dust collecting apparatus including a plurality of needle electrodes for charging floating particles in air by generating corona discharge around needle points; a plurality of cell-liked collecting electrodes provided in correspondence with the respective needle electrodes, for attracting and collecting the charged floating particles by electrostatic force; and a plurality of deflection electrodes each having a rectangularly hollow longitudinal structure comprised of a front plate portion and side plate portions and fixed the needle electrodes on the front plate portion, for applying a deflection force to the charged floating particles to move toward the collecting electrodes by a potential applied from the side plate portions, in which providing the needle electrodes each having a needle portion, a relatively thick body portion and a relatively thin body portion; applying a punch press process to a sheet metal to have a profile of the deflection electrodes; providing needle electrode mounting holes, a diameter of which is smaller than that of the relatively thick body portion but greater than that of the relatively thin body portion, at a substantially central portion of the front plate portions; inserting the relatively thin body portions of the needle electrodes into the needle electrode mounting holes from an outside of the front plate portion while bending the profile portion along in a longitudinal direction to form the deflection electrodes; and caulking the relatively thick body portion from an inside of the front plate portion, thereby the needle electrode is fixed on the front plate portion of the deflection electrode.

According to an eighth aspect of the present invention, there is provided a method of manufacturing an electric dust collecting apparatus including a plurality of needle electrodes for charging floating particles in air by generating corona discharge around needle points; a plurality of cell-liked collecting electrodes provided in correspondence with the respective needle electrodes, for attracting and collecting the charged floating particles by electrostatic force; and a plurality of deflection electrodes each having a rectangularly hollow longitudinal structure comprised of a front plate portion and side plate portions and fixed the needle electrodes on the front plate portion, for applying a deflection force to the charged floating particles to move toward the collecting electrodes by a potential applied from the side plate portions, in which there occurs providing the needle electrodes so as to each have a needle portion, a relatively thick body portion and a relatively thin body portion; applying a punch press process to a sheet metal to have a profile of the deflection electrodes; providing needle electrode mounting holes, a diameter of which is smaller than that of the relatively thick body portion but greater than that of the relatively thin body portion, at a substantially central portion of the front plate portions; inserting the relatively thin body portions of the needle electrodes into the needle electrode mounting holes from an outside of the front plate portion while bending the profile along in a longitudinal direction to form the deflection electrodes; and brazing the relatively thick body portions to the front plate portions, whereby the needle electrode is fixed on the front plate portion of the deflection electrode.

According to a ninth aspect of the present invention, there is provided a method of manufacturing an electric dust collecting apparatus including a plurality of needle electrodes for charging floating particles in air by generating corona discharge around needle points; a plurality of cell-liked collecting electrodes provided in correspondence with the respective needle electrodes, for attracting and collecting the charged floating particles by electrostatic force; and a plurality of deflection electrodes each having a rectangularly hollow longitudinal structure comprised of a front plate portion and side plate portions and fixed the needle electrodes on the front plate portion, for applying a deflection force to the charged floating particles to move toward the collecting electrodes by a potential applied from the side plate portions, in which the steps occur of providing the needle electrodes each having a needle portion, a relatively thick body portion and a relatively thin body portion; applying a punch press process to a sheet metal to have a profile of the deflection electrodes; providing needle electrode mounting holes, a diameter of which is smaller than that of the relatively thick body portion but greater than that of the relatively thin body portion, at a substantially central portion of the front plate portions; bending the profile along in a longitudinal direction to form the deflection electrodes; inserting the relatively thin body portions of the needle electrodes into the needle electrode mounting holes from an outside of the front plate portion; and brazing the relatively thick body portion to the front plate portion, whereby the needle electrode is fixed on the front plate portion of the deflection electrode.

As described the construction above, the plurality of deflection electrodes can be integrally formed from a profile punched up from a sheet metal by the punching and bending press process, enabling the manufacturing process to have good workability and productivity.

The needle electrode can be fixed to the front plate potion of deflection electrodes by not only brazing but also by caulking and impact work, enhancing production rate of the needle electrode fabricated on the deflection electrode, in addition, the needle electrode can be inserted into the needle electrode mounting hole, causing good coupling between them to increase remarkable strength, also enhancing impact resistance against the mechanical and thermal interference. Consequently, low production cost and mass-production can be achieved.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENTS

Hereinafter, embodiments of the present invention will be described with reference to the drawings.

First Embodiment

Figure 1:
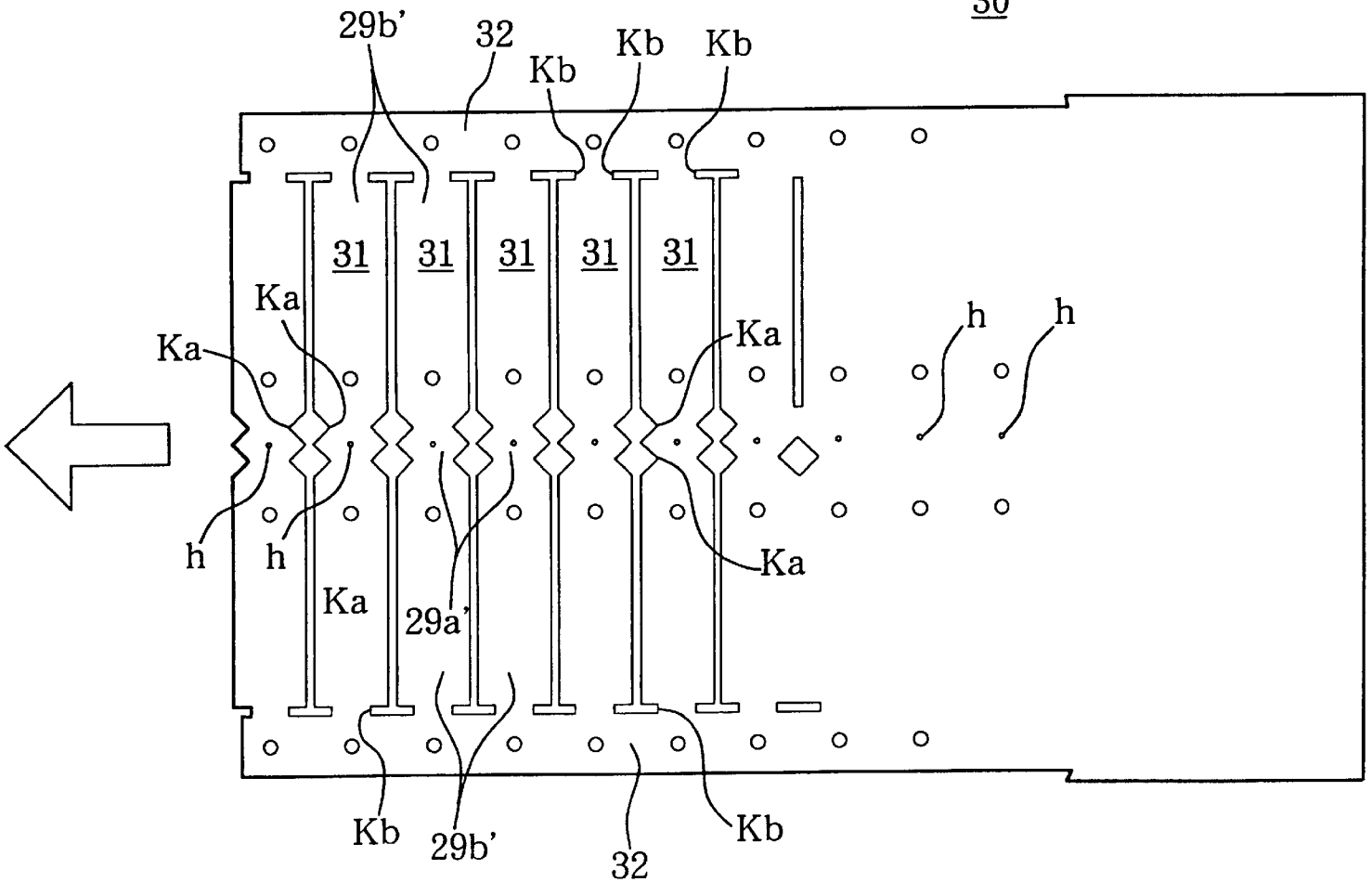
FIG. 1 is a plan view showing a profile portion of deflection electrodes for use in an electric dust collecting apparatus of an embodiment of the present invention.
Figure 2:
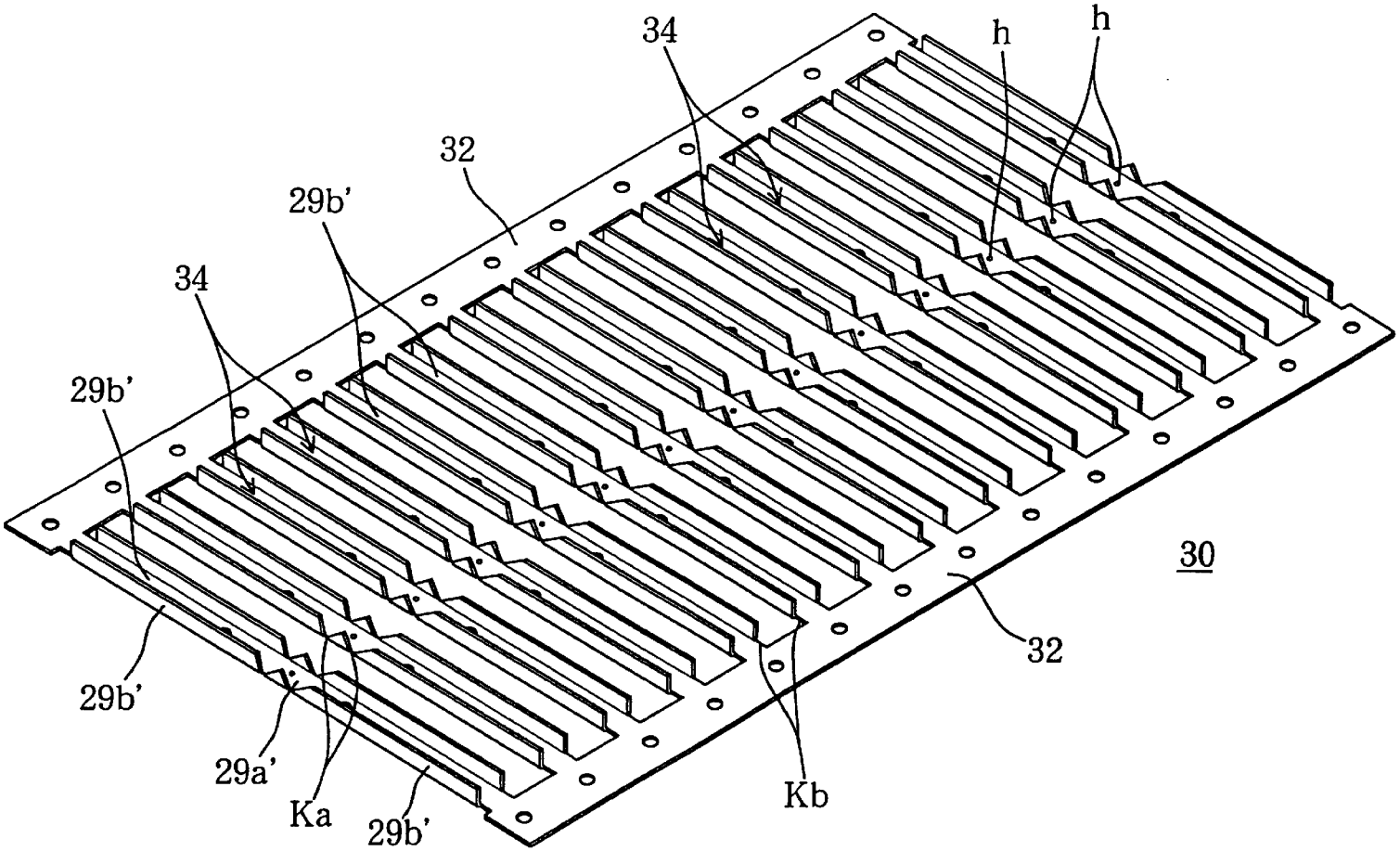
FIG. 2 is a perspective view showing a middle processed product of the deflection electrodes applied by a punching and bending process.
Figure 3:
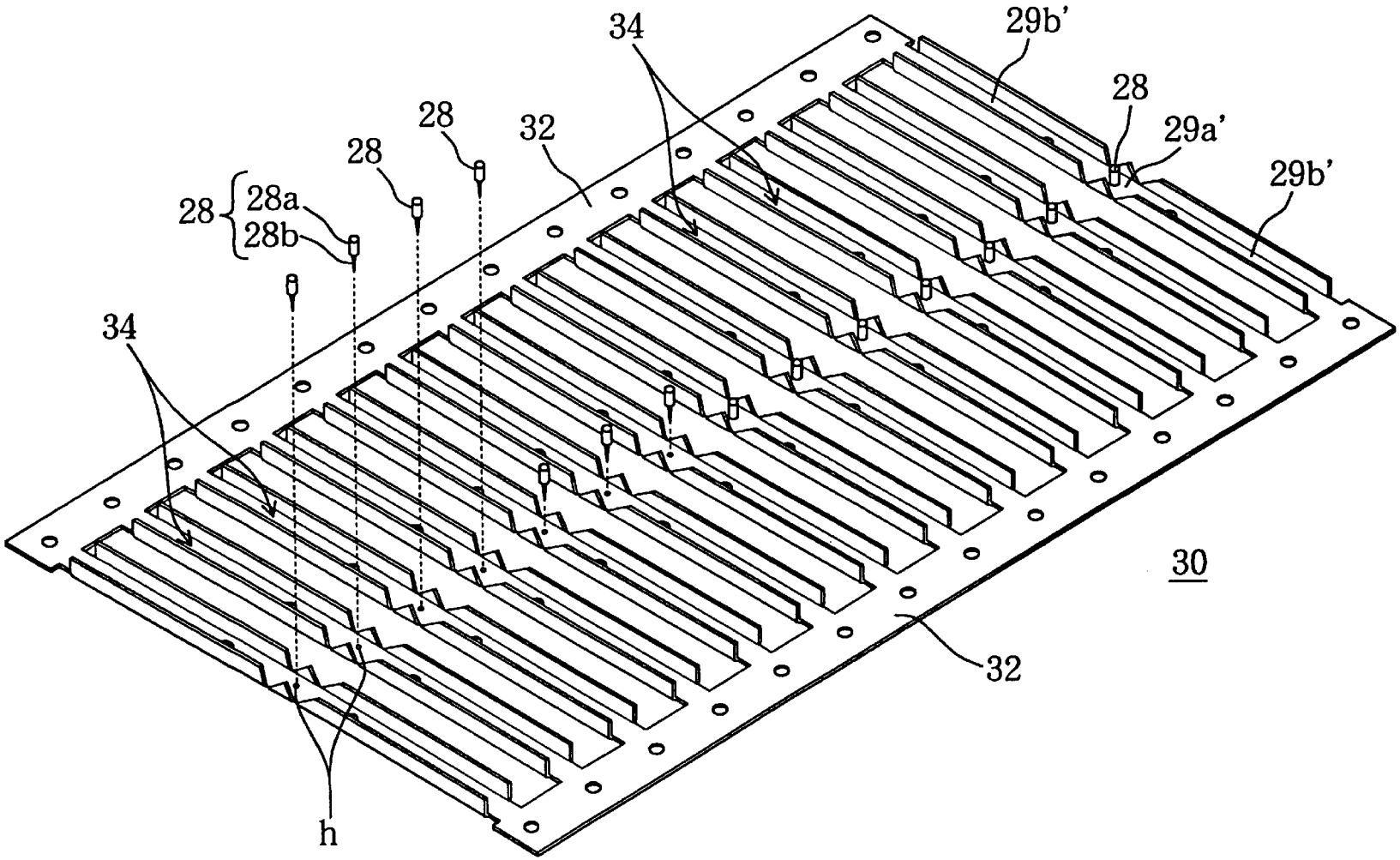
FIG. 3 is a perspective view showing a middle processed product of inserting needle electrodes.
Figure 4:
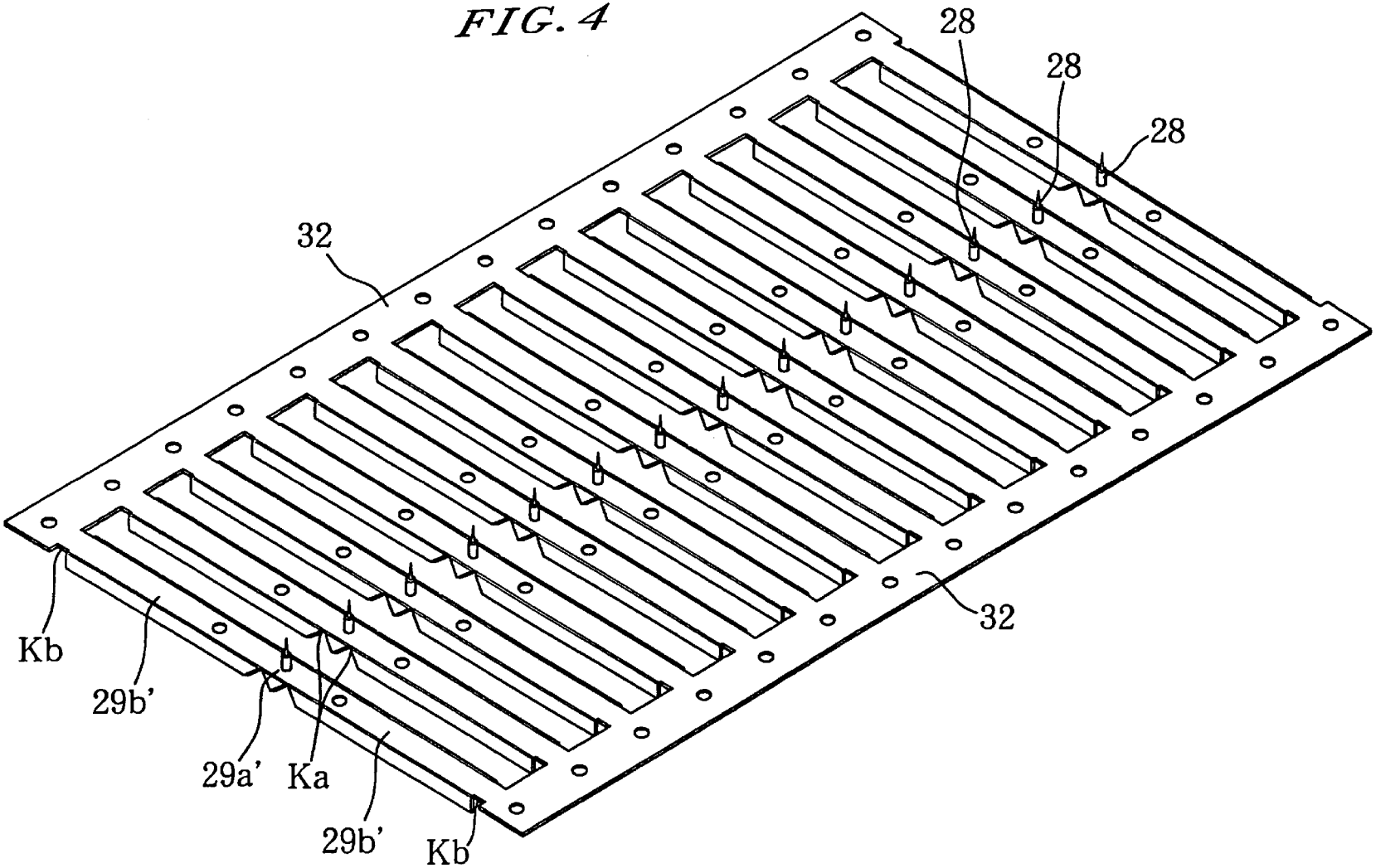
FIG. 4 is a perspective view showing a middle processed product having needle electrodes.
Figure 5A:
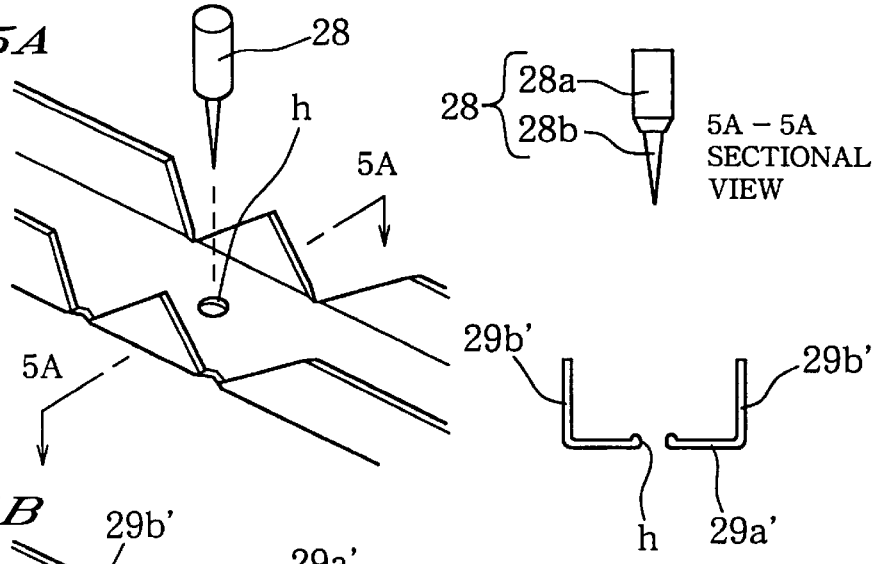
FIGS. 5(*a*) to 5(*c*) are perspective views and their sectional views showing steps of fabricating the needle electrode.
Figure 5B:
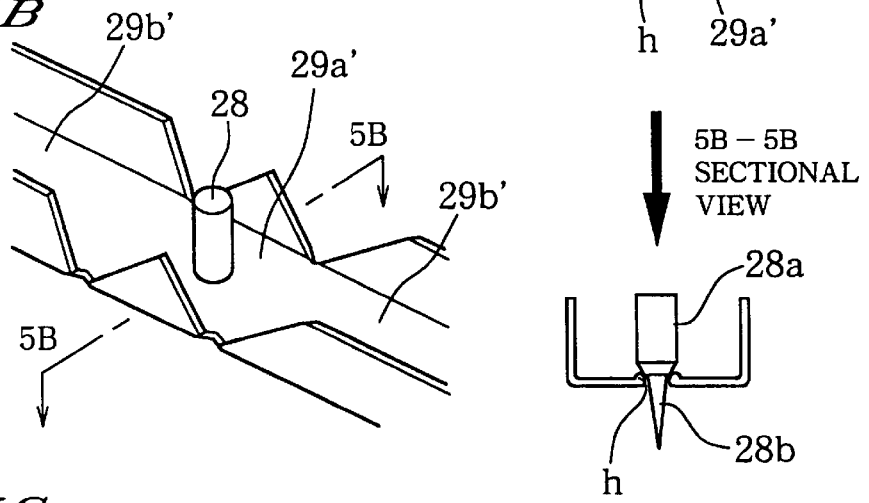
Figure 5C:
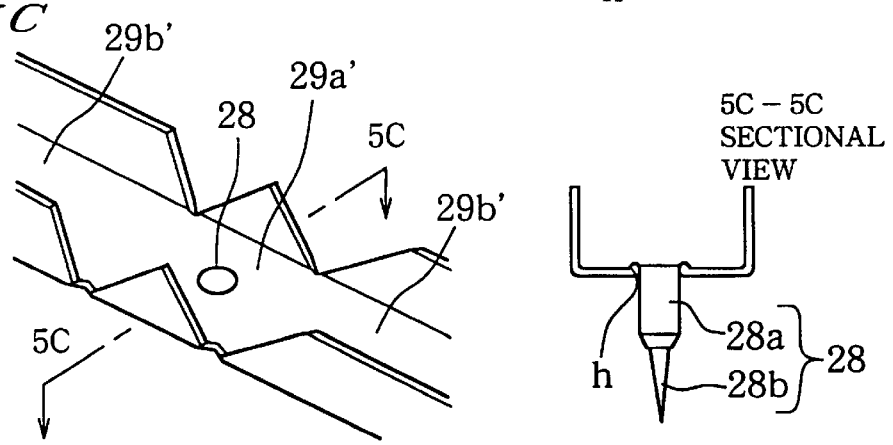
Figure 6:
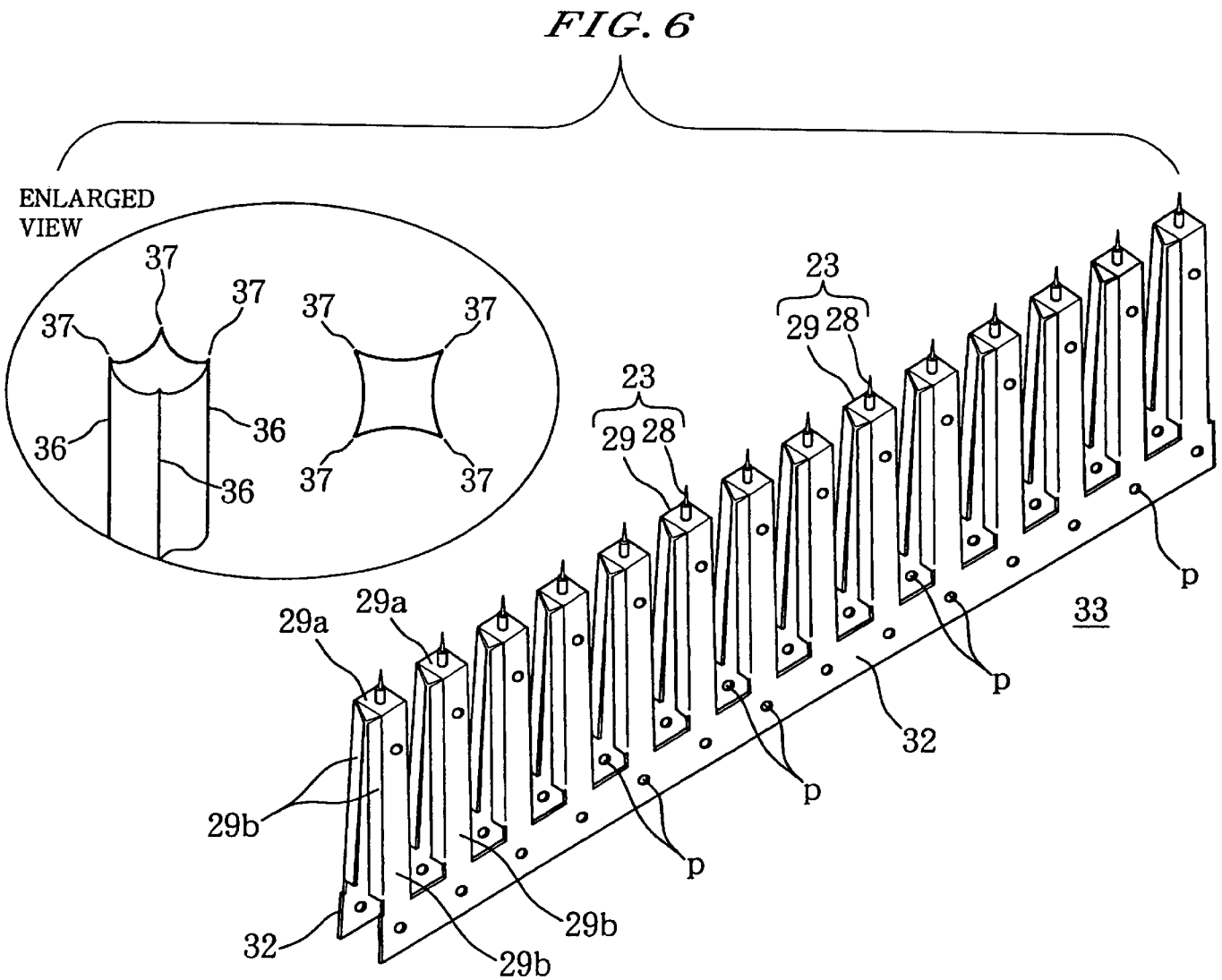
FIG. 6 is a perspective view showing the deflection coupled electrodes having the needle electrodes.
Figure 7:
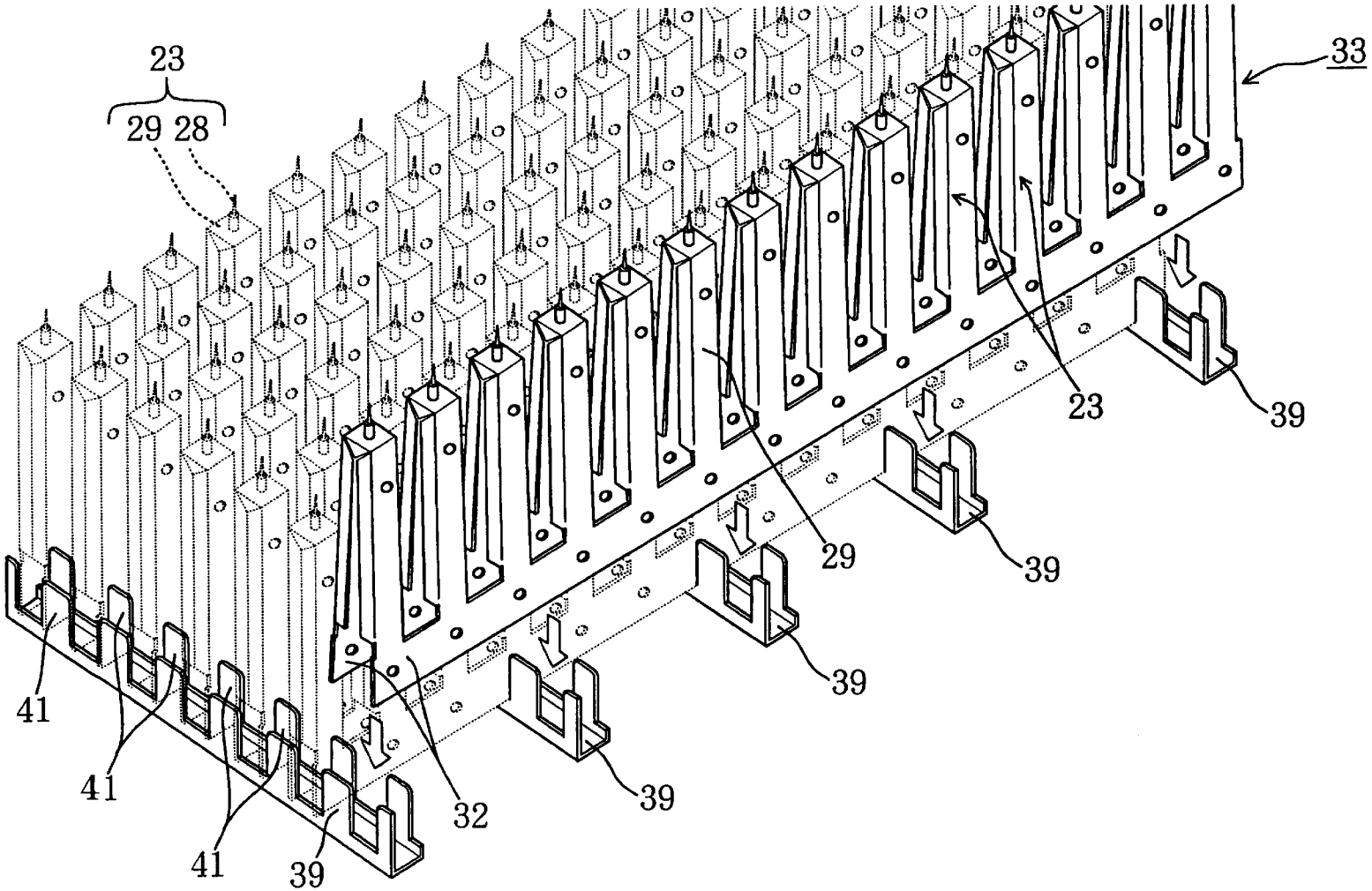
FIG. 7 is a perspective view showing a method of fabricating a male-type sub-unit having needle deflection coupled electrodes.
Figure 8:
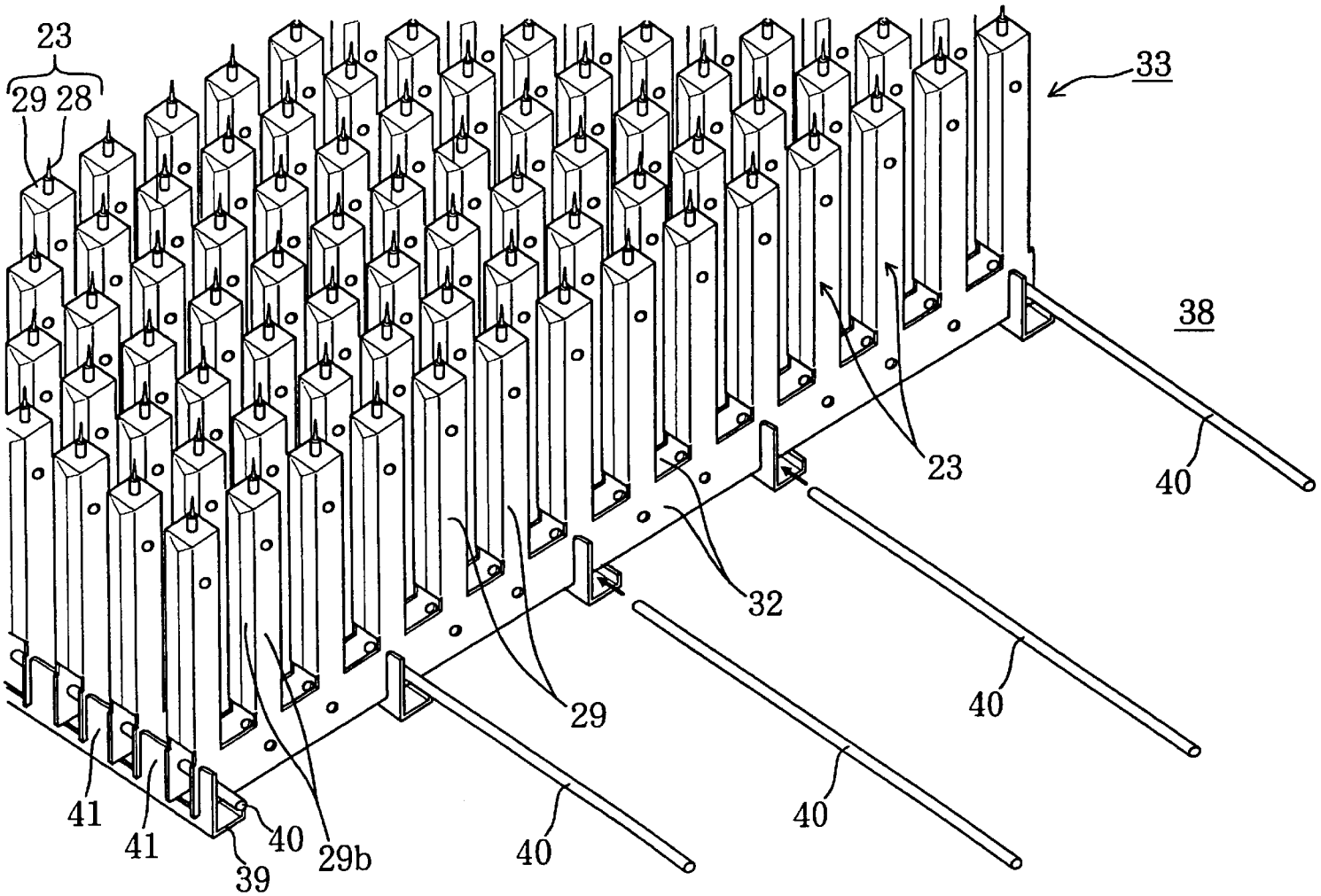
FIG. 8 is a perspective view showing a method of fabricating a male-type sub-unit having the needle deflection coupled electrodes.
Figure 9:
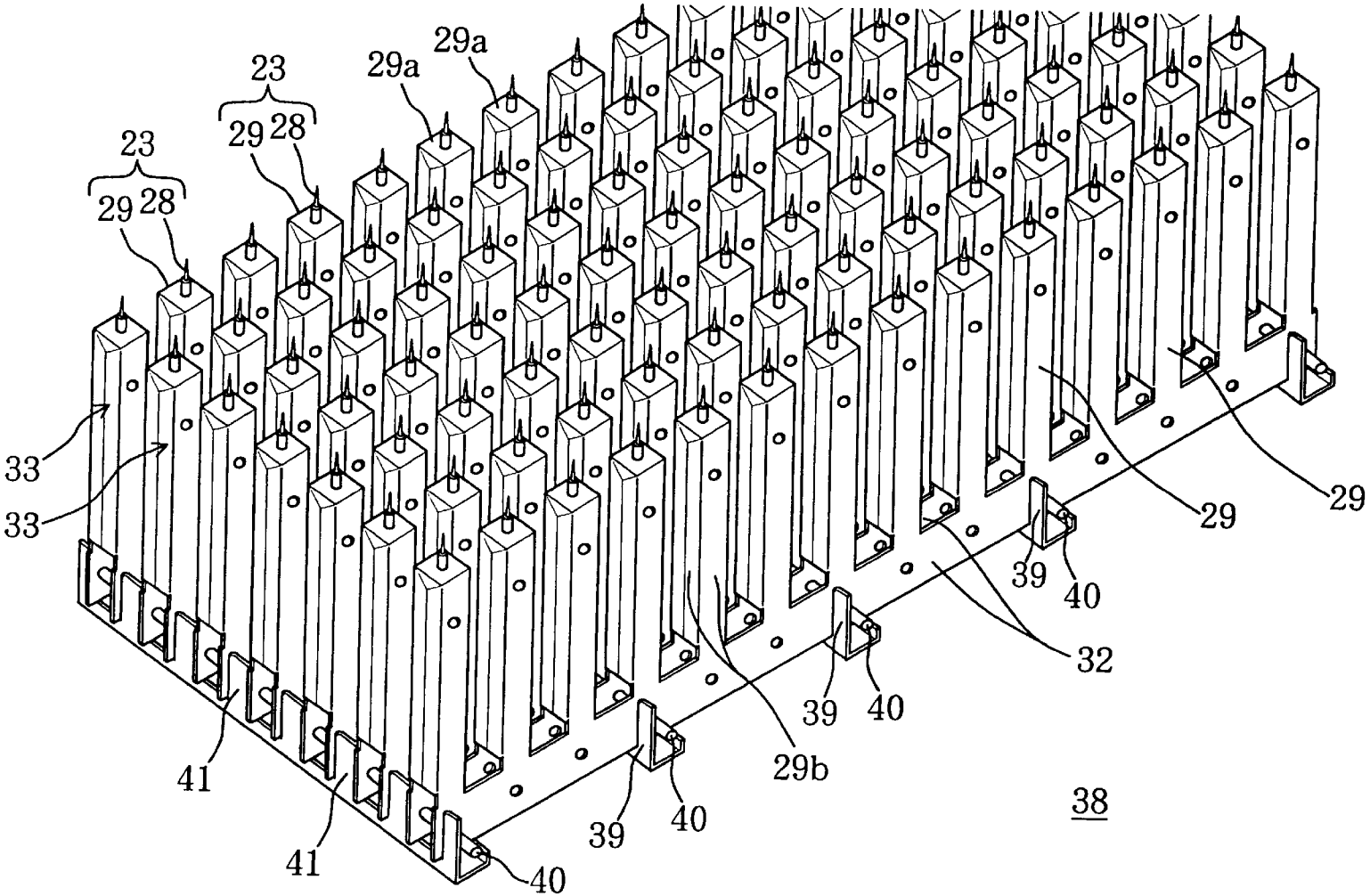
FIG. 9 is a perspective view showing a method of fabricating a male-type sub-unit having the needle deflection coupled electrodes.

FIGS. 1 to 4, 5(*a*) to 5(*c*) and 6 to 9 are explanatory views of a method of manufacturing major part of an air cleaner in a first embodiment of the present invention, concretely, of manufacturing a number of needle deflection coupled electrodes integratedly fabricated in series, in which FIG. 1 is a plan view of a profile portion punched up a sheet metal and indicating a two-dimensional shape of needle deflection coupled electrodes; FIG. 2 is a perspective view showing a middle processed product bent the profile portion by a punch press; FIGS. 3 and 4 are perspective views showing a middle processed product of inserting needle electrodes; FIGS. 5(*a*) to 5(*c*) are perspective views and their sectional views showing steps of fabricating the needle electrode; FIG. 6 is a perspective view showing the needle deflection coupled electrodes having the needle electrodes; FIGS. 7 to 9 are perspective views showing the fabricating order of a male-type sub-unit having a number of needle deflection coupled electrodes.

Figure 10:
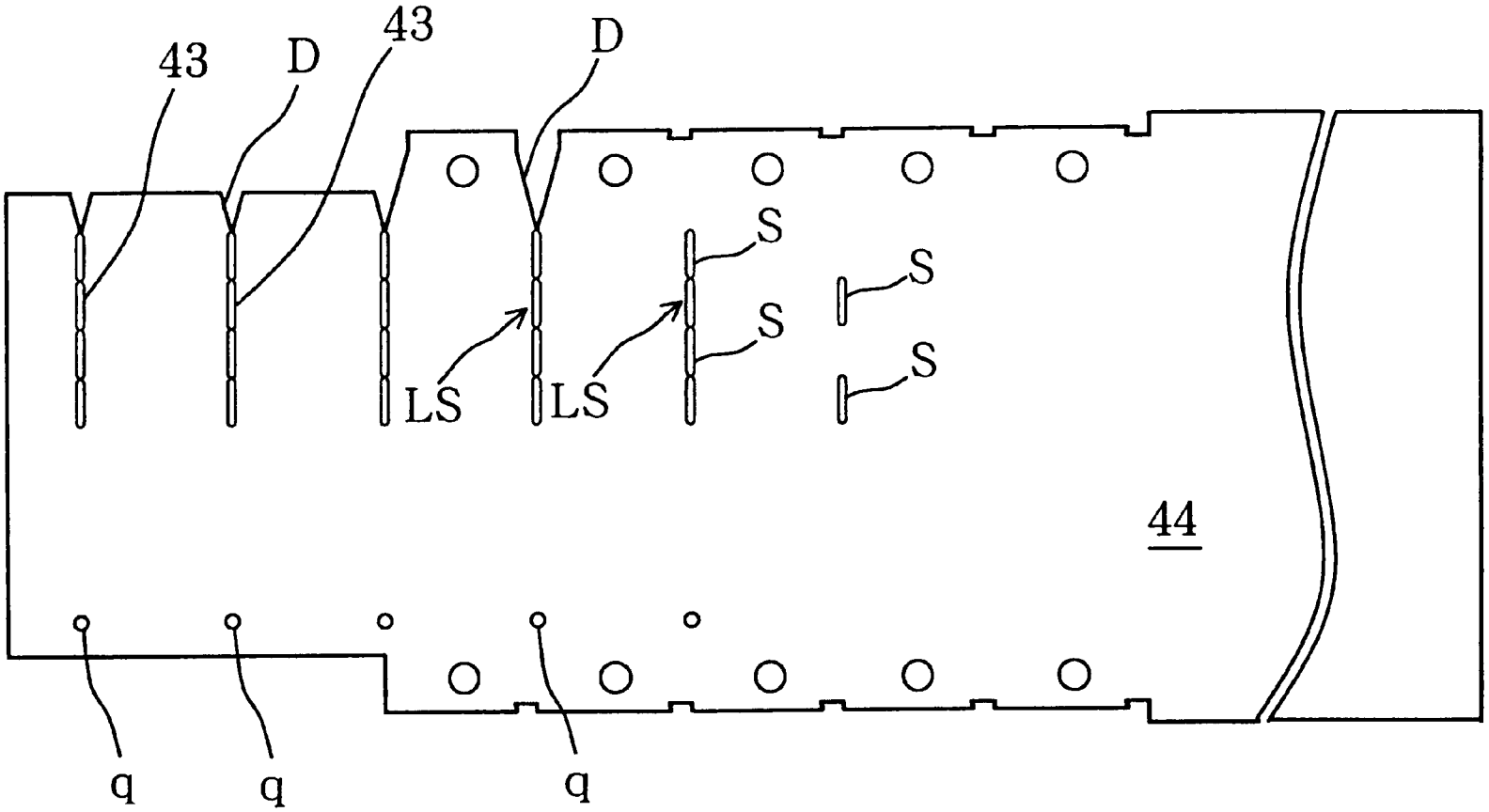
FIG. 10 is a plan view showing a profile of a collector cell provided for each of the needle deflection coupled electrodes.
Figure 11:
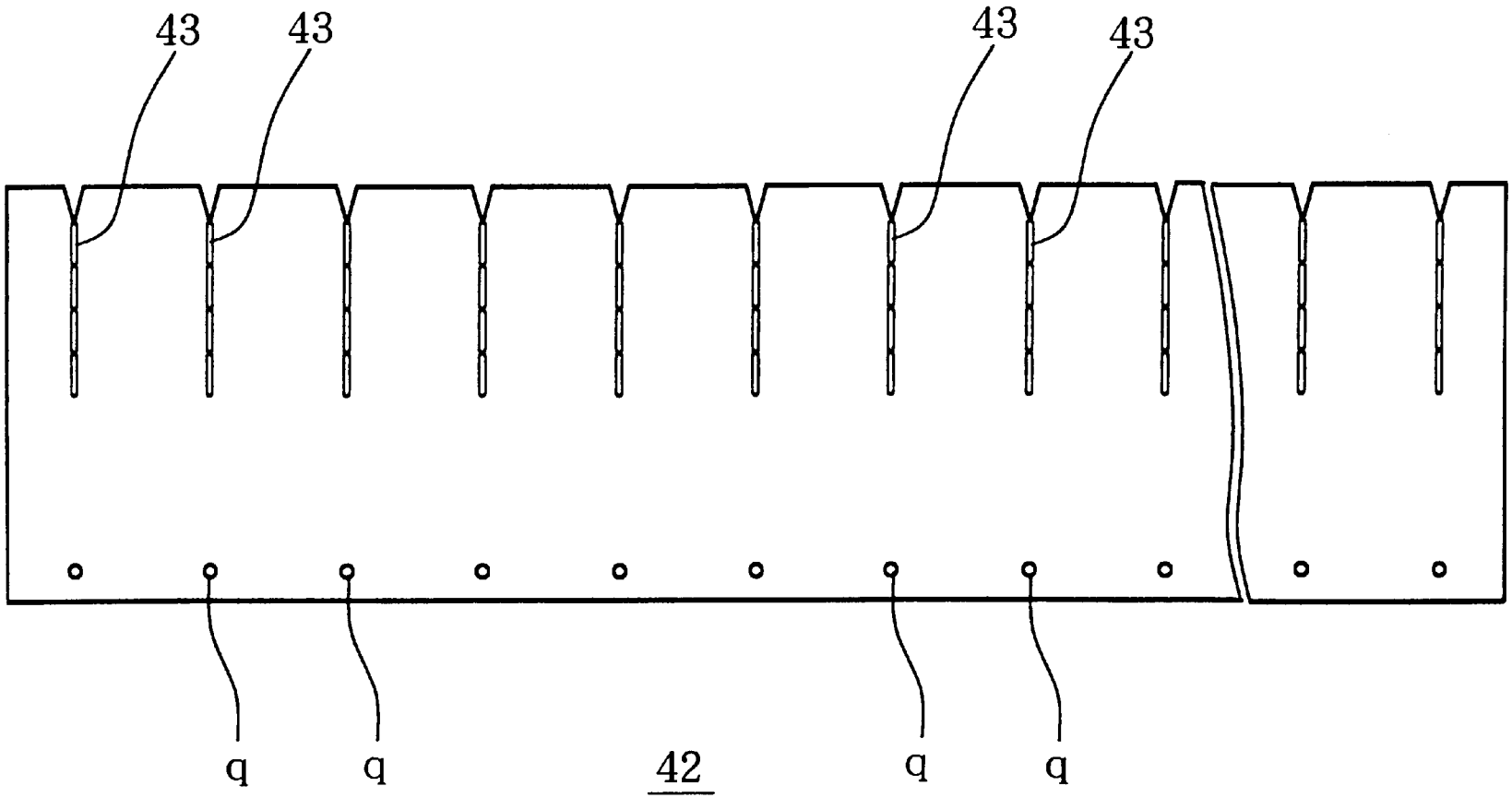
FIG. 11 is a plan view showing an electrode wall plate.
Figure 12:
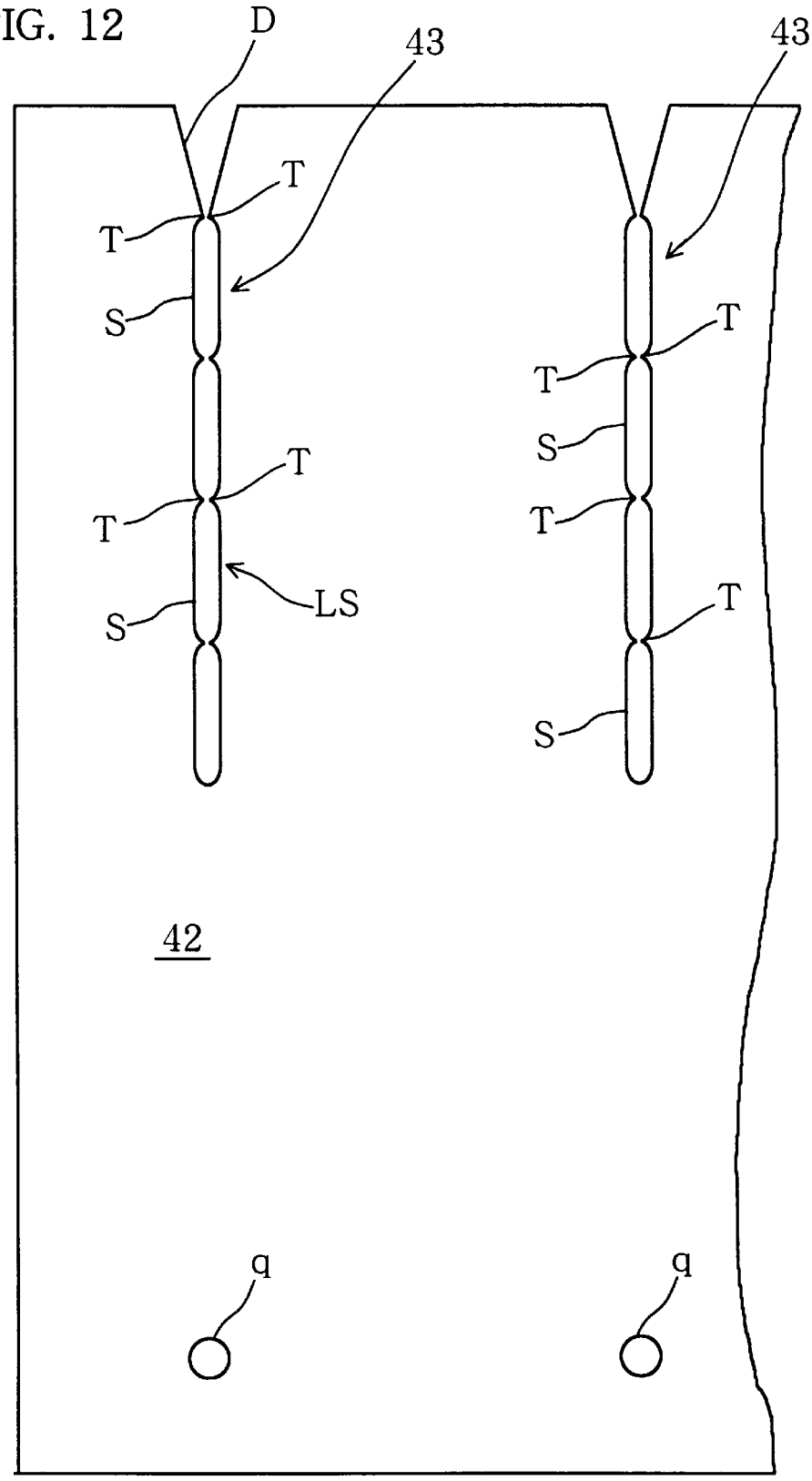
FIG. 12 is an enlarge view showing a part of FIG. 11.
Figure 13:
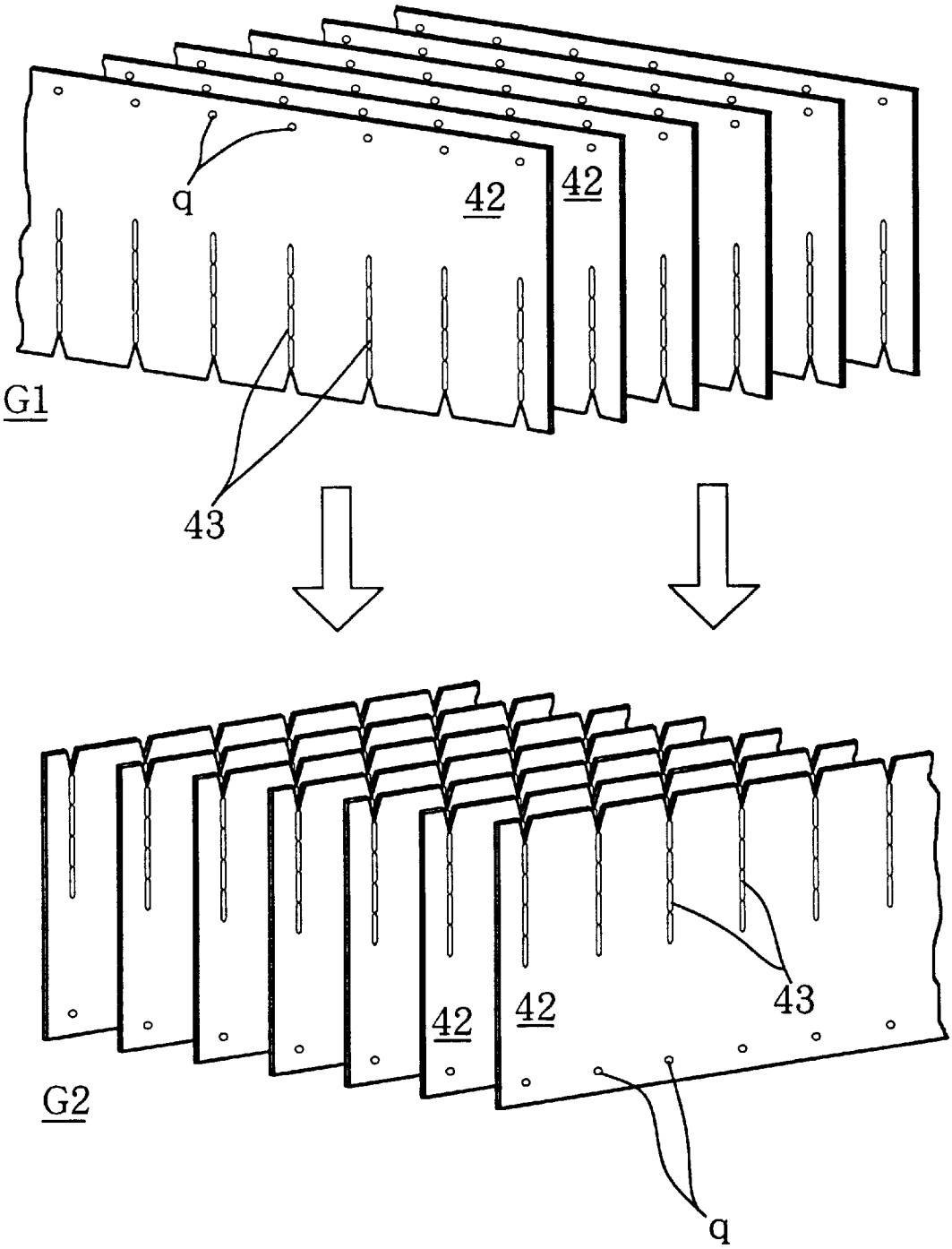
FIG. 13 is a partial perspective view showing a method of fabricating the collector cell.
Figure 14:
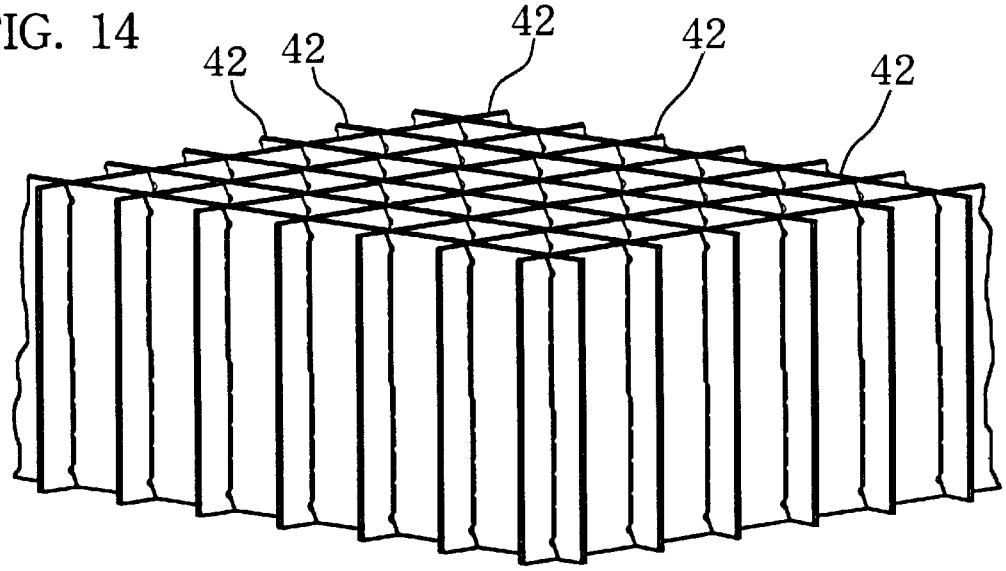
FIG. 14 is a partial perspective view showing a method of fabricating the collector cell.
Figure 15:
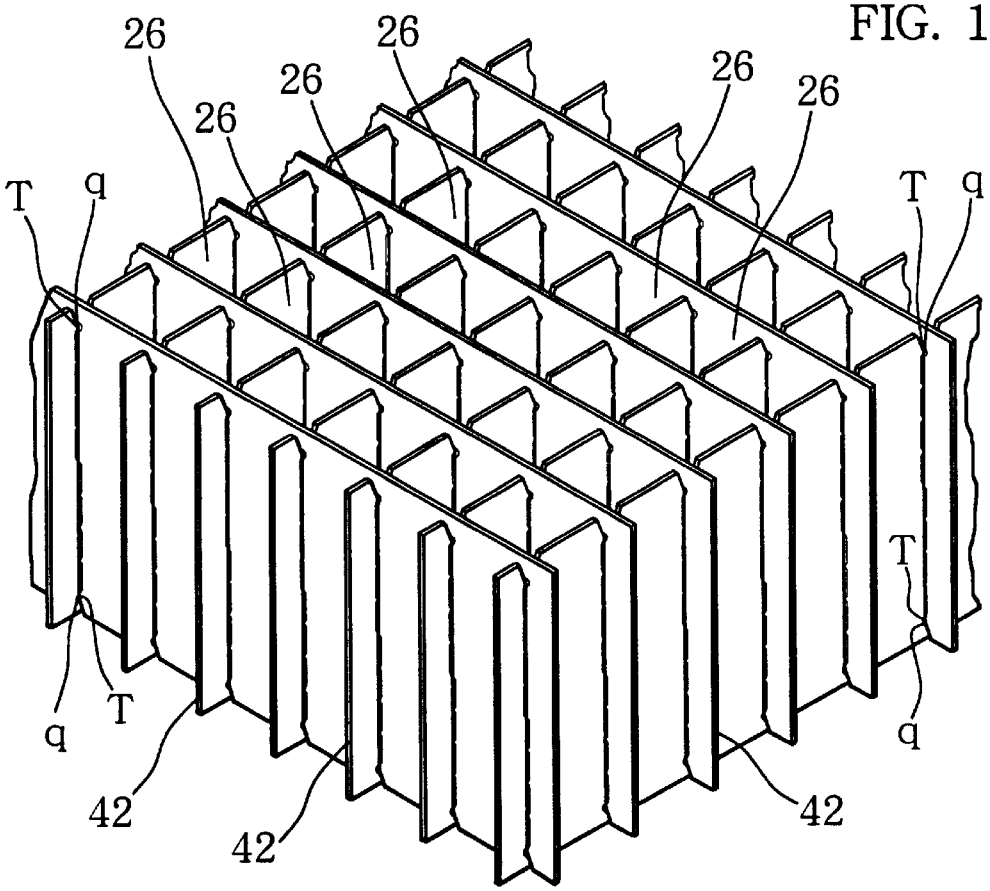
FIG. 15 is a partial perspective view showing a method of fabricating the collector cell.

FIGS. 10 to 15 are explanatory views showing a method of manufacturing a collector cell provided for each of the needle deflection coupled electrodes, in which FIG. 10 is a plan view showing a profile plate of the collector cell; FIG. 11 is a plan view showing an electrode wall plate; FIG. 12 is an enlarge view showing a part of FIG. 11; FIGS. 13 to 15 are perspective views showing the fabricating order of the collector cell.

Figure 16:
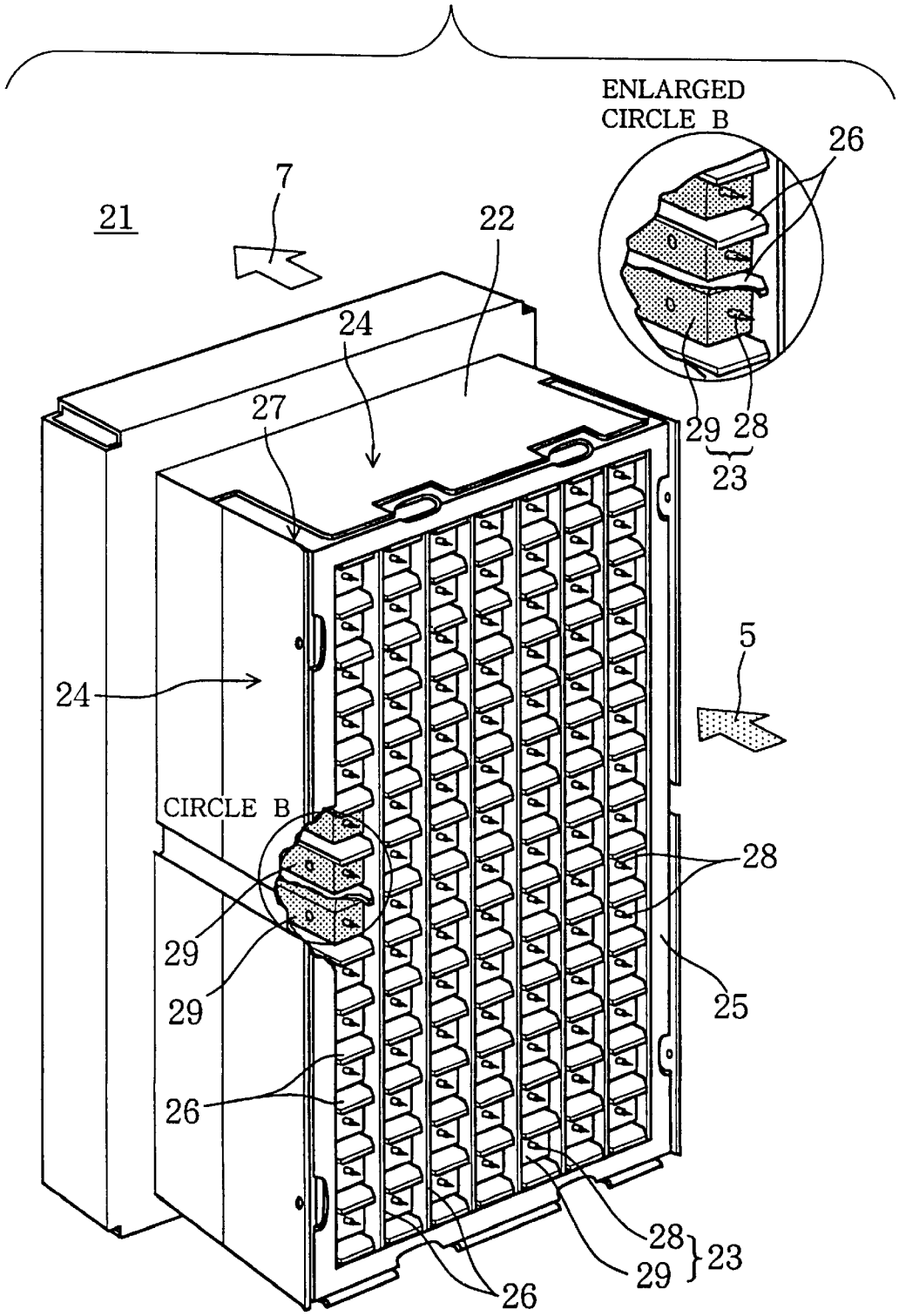
FIG. 16 is a perspective view showing a dust collecting unit in which the needle deflection coupled electrodes are fabricated with the collector cells.

FIG. 16 is a perspective view showing a dust collecting unit in which the needle deflection coupled electrodes are fabricated with the collector cells.

Figure 26:
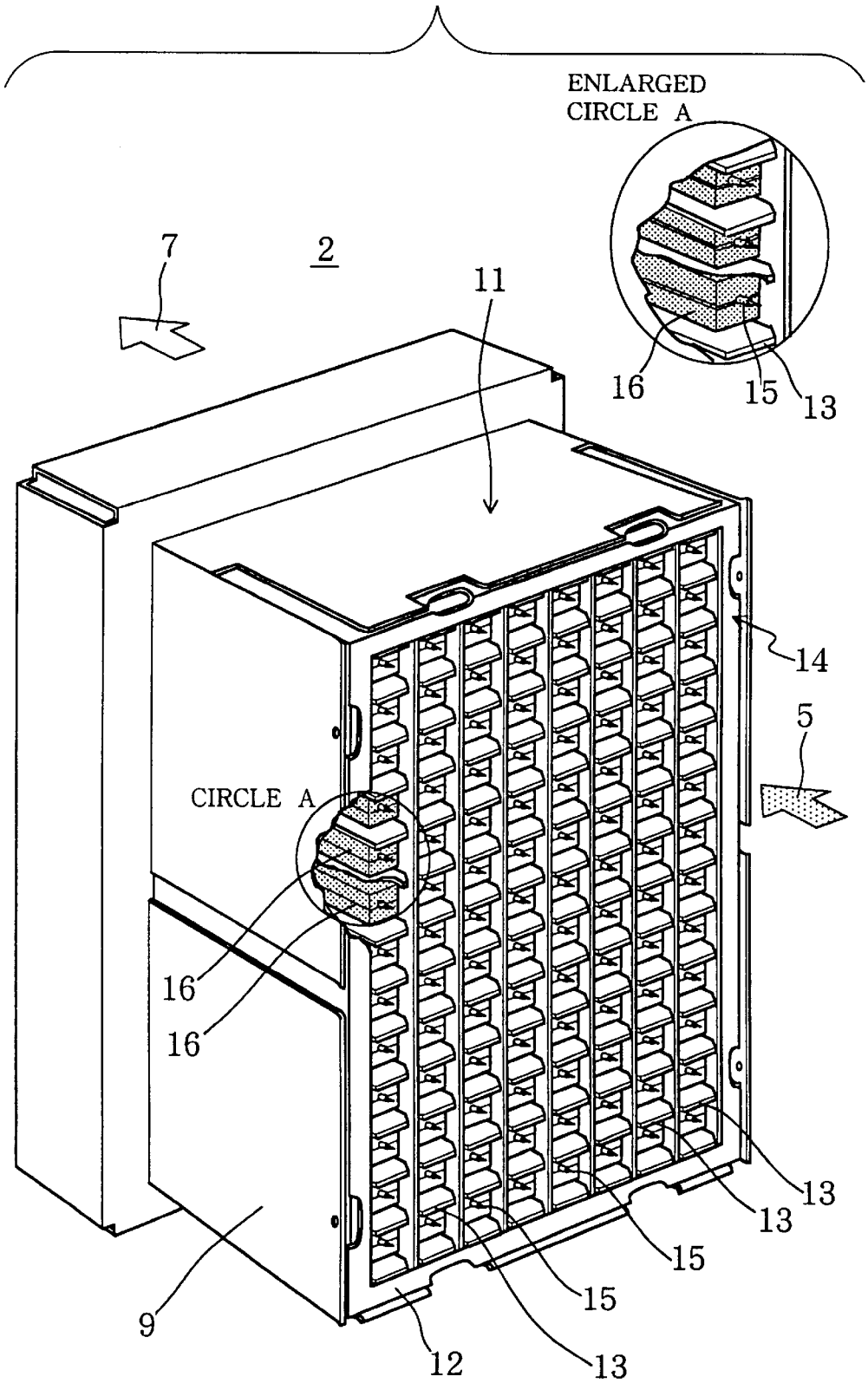
FIG. 26 PRIOR ART
FIG. 26 is a perspective view showing the front side of duct collecting unit.

Referring to FIG. 16, a dust collecting unit 21 is incorporated in an air cleaner of such a wall-hung type, a ceiling-suspended type, a floor-placed type and the like. The dust collecting unit 21 comprises a male-type sub-unit 24 having needle deflection coupled electrodes 23 arranged inside an outer case-liked frame 22 with a number of gratings arranged; and a female-type sub-unit 27 having collector cells (or collecting electrodes) 26 arranged inside an inner case-liked frame 25 with a number of gratings arranged. This is substantially similar to the dust collecting unit 2 shown in FIG. 26 in that both the frames 22 and 25 are engaged with each other to thereby arrange the collector cells 26, 26, . . . and the needle deflection coupled electrodes 23, 23, . . . in a one-to-one arrangement, or each of the needle deflection coupled electrodes 23, 23, . . . is fixedly inserted into the collector cells 26, 26, . . . with a non-contacting arranged, and wherein both the male-type sub-unit 24 and female-type sub-unit 27 are removable from each other.

Figure 27:
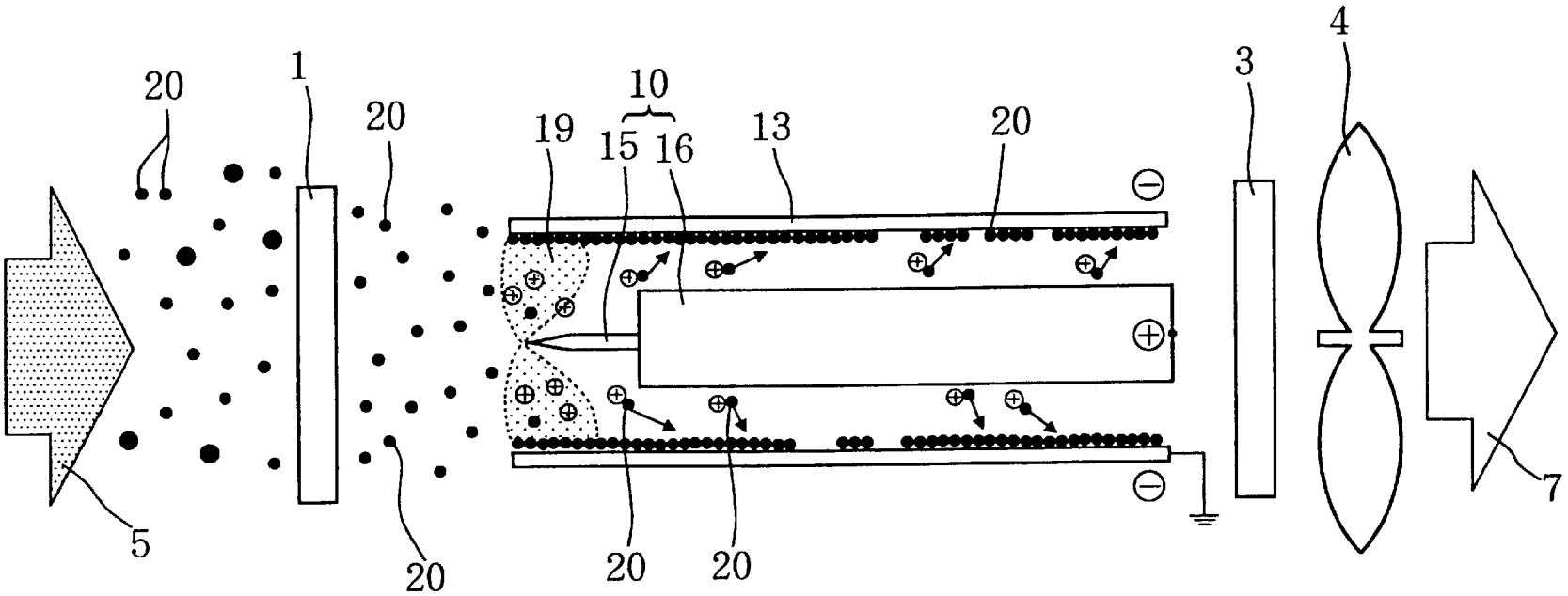
FIG. 27 PRIOR ART
FIG. 27 is an explanatory view for explaining the operation of air cleaner.
Figure 28A:
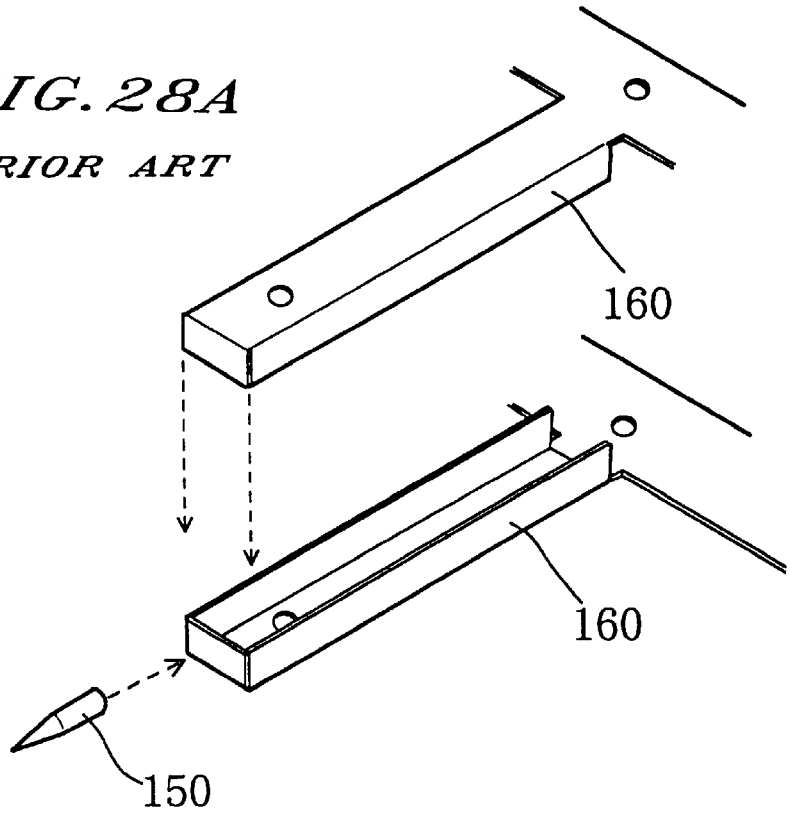
FIG. 28A PRIOR ART
FIGS. 28(*a*) and 28(*b*) are perspective views showing a method of fabricating the needle deflection coupled electrode for explaining a related art device.
Figure 28B:
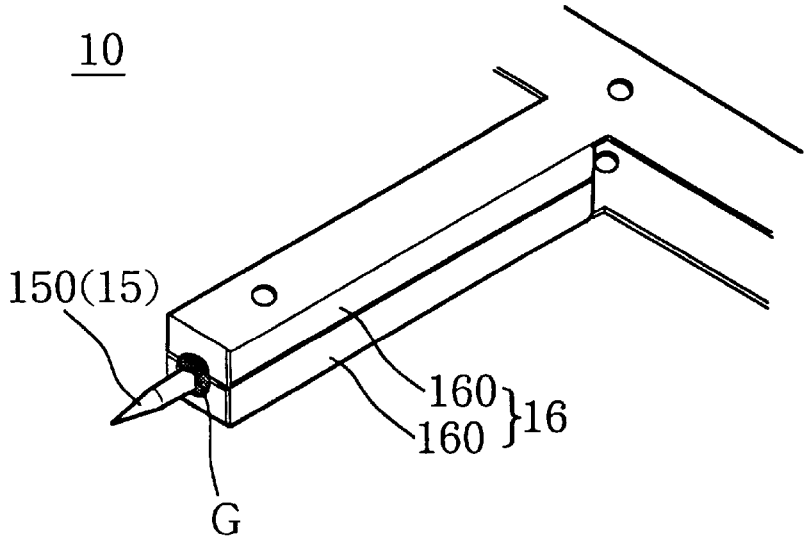
FIG. 28B PRIOR ART

The needle deflection coupled electrode 23 comprises a needle electrode 28 for generating an ionized space area to electrically charge floating particles which move through the area; and a deflection electrode (for example, approximately 10 mm in square and 5 to 6 cm in length) 29 having a rectangularly hollow longitudinal structure made up of a front plate portion 29*a* and side plate portions 29*b*, 29*b* in which the front plate portion 29*a* fixes the needle electrode 28 and the side plate portions 29*b*, 29*b* applied by a predetermined potential apply a deflection force to the charged floating particles to be moved toward the collector cell 26. This is also similar to the needle deflection coupled electrode 10 shown in FIG. 27.

On the other hand, as shown in FIG. 1, the deflection electrode 29 is formed by punching of sheet metal (for example, 0.5 mm thick) 30 to have profile portions 31 to be formed of a rectangularly hollow longitudinal structure. The side plate 29*b*', 29*b*', . . . and a triangular portion of the front plate 29*a*', 29*a*', . . . or respective profile portions 31, 31, . . . are vertically bent by a punch press process as shown in FIGS. 2 and 6, which are different from the deflection electrode 16 having the pair of bent metal plate members 160, 160 abutted each other. Each of the front plate portions of the deflection electrodes 29, 29, . . . has a mounting hole h to be mounted the needle electrode 28, as shown in FIGS. 1 and 3, which is fixedly mounted therein without using the brazing work as shown in FIGS. 4 and 9, which is unique to realize high productivity. Each of the needle electrodes 28, 28, . . . is formed by stainless steel and is comprised of a cylindrical-shaped body portion 28*a* and a needle portion 28*b* projected from the body portion 28*a* as an enlarged view shown in FIG. 5. In addition, the needle portion 28*b* is applied by nickel plating with 2 to 10 $\mu$m in thickness as a surface treatment for preventing it from oxidation.

As shown in FIGS. 6 to 9, 98 pieces of the needle deflection coupled electrodes 23, 23, . . . , or 7 columns times 14 pieces (FIG. 6) of the needle deflection coupled electrodes 23, 23, . . . are mounted on a single dust collecting unit 21. The 14 pieces of the needle deflection coupled electrode 23 as shown in FIG. 6 are integratedly arranged in series in which a pair of connecting portions 32, 32 are opposite to each other after bending the sheet metal 30 having the profile portions 31, 31, . . . along in a longitudinal direction thereof, that is, a column of needle deflection coupled electrode 33 is arranged with 7 columns in parallel, constituting a dust collecting unit 21.

Referring to FIGS. 1 to 6, a manufacturing method of the column of needle deflection coupled electrode 33 will be described next.

First, a punch press line comprising a punch and die set is provided for producing a profile of the needle deflection coupled electrodes 33, 33, . . . . A sheet metal (for example, 0.5 mm in thickness) 30 such as stainless steel and the like or the profile of the electrodes 33, 33, . . . is punched up by the punch press line as shown in FIG. 1 in which 14 profile pieces of the deflection electrodes 29, 29, . . . are formed on the sheet metal 30 having a punching hole, a punching profile and a notch opened. The sheet metal 30 of the deflection electrodes 29, 29, . . . also has a layout such that the front plates 29*a*', 29*a*', . . . lie in the center of the sheet metal 30 on the longitudinal direction and side plates 29*b*', 29*b*', . . . lie in both sides of the front plates 29*a*', 29*a*', . . . in symmetry with respect to the front plates 29*a*', 29*a*', . . .

The pair of connecting portions 32, 32 positioned parallel on the sheet metal 30 are also formed by the punch press process, so that 14 pieces of the deflection electrodes 29, 29, . . . are integratedly formed on the pair of connecting portions 32, 32 with a predetermined pitch arranged. The pair of connecting portions 32, 32 also have a plurality of rod penetrated holes p, p, . . . with a predetermined pitch arranged to be penetrated a rod coupled member (metal rod) 40.

As shown in FIG. 1, two pairs of triangularly shaped notches (hereinafter, referred to as triangle notch) Ka, Ka, . . . are formed on the central part of the sheet metal 30 in the longitudinal direction. A pair of rectangularly shaped notches (hereinafter, referred to as rectangular notch) Kb, Kb, . . . are also formed on both the edge portions close to the connecting portions 32, 32. As shown in FIG. 2 two lines intersected in the longitudinal direction of the sheet metal 30 and extended from one ends of the rectangular notch Kb to the other ends of the rectangular notch Kb through the deep points of the triangle notches Ka, Ka are two bending lines to be bent such as the side plate 29*b*', 29*b*', . . . and the triangle pieces of the front plate 29*a*' are vertically bent, and as shown in FIG. 6, two lines extended through one deep points of the triangle notches Ka, Ka, . . . and the other deep points of the triangle notches Ka, Ka, . . . both in the longitudinal directions of the sheet metal 30 are two bending lines to be bent such that the pair of connecting portions 32, 32 are opposite to each other. Also, the length across rectangular notches Kb and Kb is approximately 10 mm.

As described above, the mounting hole h is opened at each central portion of the front plate 29*a*', 29*a*', . . . , the diameter of mounting hole h is larger than that of the needle portion 28*b* of needle electrode 28, but smaller than that of the body portion 28*a*.

As described two bending lines in the direction intersecting the longitudinal direction of the sheet metal 30 above, the punch press process is applied to those lines to be bent approximately 90 degrees so that 14 pieces of U-shaped middle processed portions 34, 34, . . . are formed integratedly together with the pair of connecting portions 32, 32 as shown in FIG. 2. Subsequently, the middle processed portions 34, 34, . . . remain facing upward, then the needle electrodes 28, 28, . . . are inserted into the mounting holes h, h, . . . from above, as shown in FIGS. 3 and 5(*a*). At this time, since the diameter of needle portion 28*b* of the needle electrode 28 is smaller than that of the mounting hole h, the needle portion 28*b* is penetrated thereinto easily, but the diameter of body portion 28*a* is larger than that of the mounting hole h, to this end, the body portion 28*a* of needle electrode 28 is held by the mounting hole h, as shown in FIGS. 3 and 5(*b*).

An air hammer, which is not shown in the drawing, then applies impact to the back surface of body portion 28*a* to be driven into the mounting hole h. At this time, the mounting hole h is deformed by driving the body portion 28*a* thereinto, so that the body portion 28*a* of needle electrode 28 is tightly fixed on the mounting hole h with generation of resilient restitutive force and high friction as shown in FIGS. 4 and 5(*c*). As described the process above, middle processed portions 35, 35, . . . having the needle electrodes are formed as shown in FIG. 4. Thereafter, the punch press process is applied to the two lines extended through the deep points of triangle notches Ka, Ka, . . . in the longitudinal direction of the sheet metal 30 or the middle processed portions 35, 35, . . . to be bent in approximately 90 degrees, thereby forming 14 pieces of the deflection electrodes 29, 29, . . . each having a rectangularly hollow longitudinal structure with an integratedly arranged in series and completing a column of needle deflection coupled electrode 33 as shown in FIG. 6.

In the bending process described above, the punch or male punch may be used of an ordinary rectangular column type having four flat surfaces corresponding to the shape of deflection electrode 29 in the longitudinal direction, but may desirably be used of another rectangular column type having an acute angle at four edges 36, 36, . . . or four concave surfaces in the longitudinal direction, and the top surface of punch is also a concave surface having four vertexes of the acute angles as an enlarged view shown in FIG. 6, so that the dust collecting efficiency may be increases since the four edges along the rectangular column can be made sharp, which has found in experiment.

Referring to FIGS. 7 to 9, the fabrication of male-type sub-unit body 38 having 7 columns of needle deflection coupled electrodes 33, 33, . . . will be described next. As shown in FIG. 7, since a column of needle deflection coupled electrode 33 having 14 pieces of the needle deflection coupled electrodes 23, 23, . . . is provided for 7 columns thereof which are coupled electrically (or equally coupled potential), a plurality of comb-type coupling members 39, 39, . . . and rod coupling members (metal rod) 40, 40, . . . .

are fabricated to the 7 columns of needle deflection coupled electrodes 33, 33, . . . The comb-type coupling member 39, 39, . . . are formed by punching a sheet metal to have a profile plate having alternately arranged teeth portions 41, 41, . . . and bending it in the longitudinal direction for vertically forming the teeth portions in two columns. The teeth portions 41, 41, . . . of comb-type coupling member 39 are engaged with 7 columns of needle deflection coupled electrodes 33, 33, . . . from the bottom thereof. The case shown in FIG. 7 uses 5 pieces of comb-type coupling members in approximately equal intervals. In addition, referring to FIG. 8, since the electrically and mechanically coupled arrangement enhances the 7 columns of needle deflection coupling electrodes 33, 33, . . . , the rod coupling members 40, 40, . . . are tightly penetrated into the plurality of rod penetrated holes p, p, . . . formed on the pair of connecting portions 32, 32, so that the 7 columns of needle deflection coupled electrodes 33, 33, . . . are coupled with electrically and mechanically secured structure by the penetration of the rod coupling members 40, 40, . . . , completing the male-type sub-unit body 38 having the 7 columns of needle deflection coupled electrodes 33, 33, . . . as shown in FIG. 9.

Thereafter, such completed male-type sub-unit body 38 is incorporated into the outer case-liked frame 22 (FIG. 16) through an insulating joint plate (not shown in the drawing), which constitutes the male-type sub-unit 24.

Referring to FIGS. 10 to 15, a manufacturing method of the collector cells 26, 26, . . . will be described below. The collector cells 26, 26, . . . are comprised of a plurality of rectangularly shaped electrode wall plates 42, 42 . . . , each of which has slits 43, 43 . . . with triangle notch portions D, D, . . . extended from a long edge of the plate 42 to nearly middle portion thereof as shown in FIGS. 11 and 12. The first set of electrode wall plates 42, 42 . . . are respectively engaged with the other set 42, 42, . . . , the slits 43 of the one intersecting those of the other. Therefore, grating-liked hollows are formed by engaging the one number of electrode wall plates 42, 42, . . . and the other number thereof 42, 42, . . . , which are referred to as collector cells 26, 26, . . . . each of which houses the needle deflection coupled electrode 23, as shown FIGS. 14 and 15. Referring back to FIGS. 11 and 12, the electrode wall plate 42 also has fastening holes q, q, . . . besides the slits 43, 43, . . . and each of the slits 43, 43, . . . has spines T, T . . . along the slit 43 as shown in FIG. 12.

The slits 43, 43, . . . are formed by a punch and die set comprising four sequential elongated oval-liked portions S and one triangle notch portion D, for punching a sheet metal 44 of 3 mm in thickness as shown in FIG. 10, in which the size of elongated oval-liked portion is approximately 7 mm long and 1 mm wide. Such punch and die set are provided two sets with a predetermined interval arranged in parallel on a base stage, and the sheet metal 44 is punched every two slits 43, 43 at one punch press process in the longitudinal direction thereof, forming the slits 43, 43, . . . each having a triangle notch D, a four elongated oval-liked portions S entirely designated by LS, and four pairs of spines T as shown in FIG. 12. One set of electrode wall plates 42, 42, . . . and the other set thereof produced by the punch press process described above are easily fitted with each other at the triangle notch portions D, D, . . . and firmly engaged with each other at the spines T, T . . . . It should be noted that an interval between a pair of spines T, T of triangle notch portions D, D is 0.295 $\mu$m and that between a pair of spines T, T of the elongated oval-liked portions S, S . . . is 0.295 $\mu$m as well. In addition, an interval between the pair of spines T, T is smaller than the thickness (0.3 mm in thickness) of electrode wall plate 42 by desirably as much as 3 to 20 $\mu$m. The length of slit 43 may also set to an approximately half width of the electrode wall plate 42 in consideration of fabricating the collector cells 26, 26, . . . The fastening holes q, q, . . . may be formed with the same punch press process for forming the slits 43, 43, . . . extended from the slits 43, 43, . . . to the other long edge of sheet metal 44 or electrode wall plate 42 in alignment, distance from the other long edge of the electrode wall plate 42 to a center of the fastening hole q may be approximately the same as the depth of triangle notch portion D, as shown in FIG. 12.

Referring to FIG. 13, the fabrication of electrode wall plates 42, 42, . . . or the collector cells 26, 26, . . . will be described next. A plurality of electrode wall plates 42, 42, . . . are provided as a group G1 and those of electrode wall plates 42, 42, . . . are provided as a group G2. The group G1 is engaged to the group G2 from above at 100 to 135 degrees intersecting angle (or superior angle) between the groups G1 and G2, that is, a number of grating-liked rhombus cells are formed as shown in FIG. 14 and a number of square cells are then formed by an externally applied force from two opposite vertexes of the fabricated unit in a diagonal direction, completing the collector cells 26, 26, . . . as shown in FIG. 15. It is noted that the groups G1 and G2 can easily and firmly be engaged with each other since the interval between the spines T, T is smaller than the thickness of electrode wall plate 42 by as much as 3 to 20 $\mu$m, and also, a large force is not required for engaging both the groups G1 and G2.

According to the fabrication of collector cells 26, 26, . . . , the 98 pieces of cells are formed in one unit which is incorporated into the inner case-liked frame 25, completing a female-type sub-unit 27 as shown in FIG. 16.

The female-type sub-unit 27 and the male-type sub-unit 24 as described above are incorporated into the inner and outer case-liked frame 25 and 22 respectively, which are engaged with each other to constitute a dust collecting unit 21. As a dust collecting unit 21 shown in FIG. 16, the needle deflection coupled electrodes 23, 23, . . . correspond to the collector cells 26, 26, . . . respectively in which each of the needle deflection coupled electrodes 23, 23, . . . are attached to each of the collector cells 26, 26, . . . with non-contact arranged therein. It is noted that the male-type sub-unit 24 is removable from the female-type sub-unit 27. Such a dust collecting unit 21 is incorporated into an air cleaner in which the needle defection coupled electrodes 23, 23, . . . are electrically connected with the collector cells 26, 26, . . . so that the needle deflection coupled electrode 23 sets to positive potential while the collector cell 26 sets to negative potential during operation. Because of this, a high direct current voltage such as 5 to 6 kV is applied to the air cleaner.

In such construction of the air cleaner, the plurality of deflection electrodes 29, 29, . . . comprising the dust collecting unit 21 as describe above are formed by punching and bending up a single sheet metal 30 to produce it integratedly and simultaneously, enhancing workability and productivity.

The needle electrodes 28, 28, . . . are fixedly mounted on the deflection electrodes 29, 29, . . . by the impact without using the brazing work, so that the mounting work of needle electrode 28 is remarkably enhanced. The proximal end of needle electrode 28 is inserted and firmly fixed to the front plate portion 29*a*, so that the Junction and impact resistance of those are remarkably enhanced.

Referring back to FIG. 15, the pair of spines T, T are formed on the triangle notch portion D and the elongated oval-liked portions S, S . . . on the slits 43, 43, . . . , therefore, excellent fastening effect acts on the electrode wall plates 42, 42, . . . , no displacement occurs and impact resistance of the collector cells 26, 26, . . . enhances.

As a result, productivity and low cost of manufacturing the air cleaner can be achieved.

Second Embodiment

A second embodiment of the present invention will be described next.

Figure 17A:
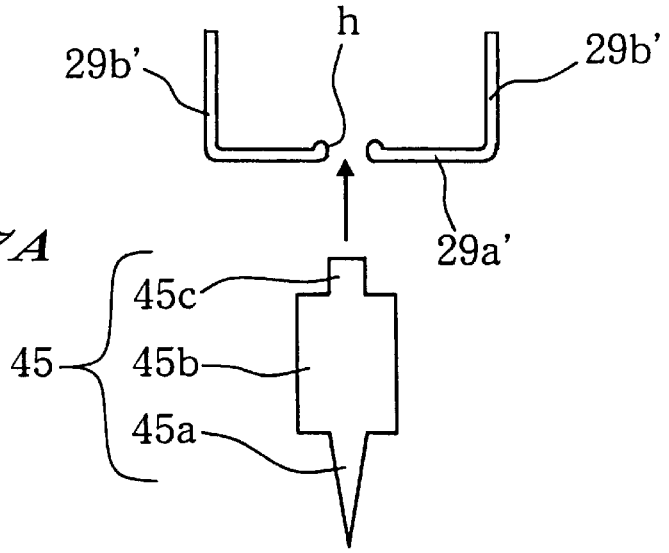
FIGS. 17(*a*) to 17(*c*) are explanatory views showing a method of fabricating the needle electrode to the deflection electrode in a second embodiment of the present invention.
Figure 17B:
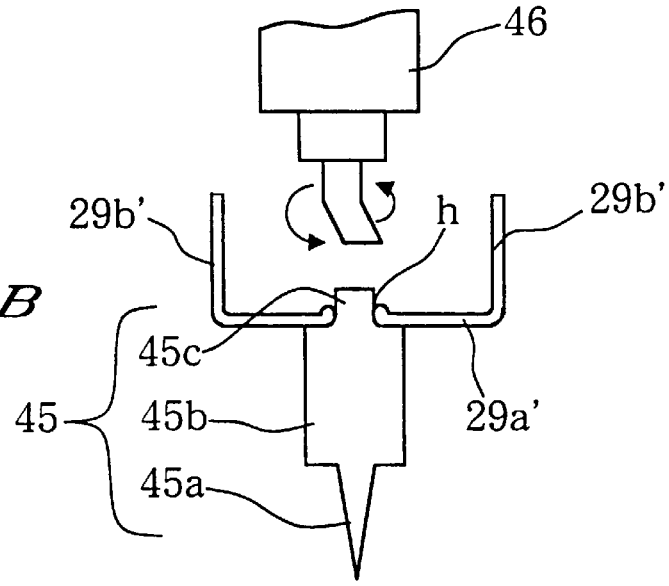
Figure 17C:
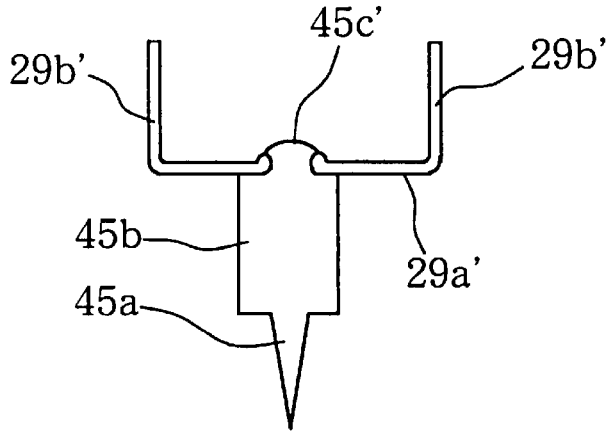

FIGS. 17(*a*) to 17(*c*) are diagrammatical explanatory views showing a method of mounting the needle electrode on the deflection electrode.

The second embodiment is different from the first embodiment in that the needle electrode 45 is fixed to the deflection electrode 29 by a caulking manner instead of by the impact and that the needle electrode 45 has a needle portion 45*a*, a relatively thick portion 45*b* and a relatively thin portion 45*c* instead of having the needle portion and body portion. Detailed descriptions of manufacturing those are omitted since the mostly same method in the first embodiment is involved in the second embodiment, therefore, the same reference numerals are designated on FIGS. 17(*a*) to 17(*c*) as used on FIGS. 5(*a*) to 5(*c*).

The method of mounting the needle electrode 45 on the deflection electrode 29 will now be described with reference to FIGS. 17(*a*) to 17(*c*).

In order of fixing the needle electrode 45 to the middle processed portions 34 34, . . . (referring to FIG. 2) as shown in FIG. 17(*a*), the relatively thin portion 45*c* of needle electrode 45 is inserted into the mounting hole h, edge portion of which is bent toward the inner side of side plate 29*b*', and the needle electrode 45 is held by a tool which is not shown in the drawing.

Subsequently, as shown in FIG. 17(*b*), an eccentric caulking tool 47 attaching to a high speed eccentric caulking machine 46 is rotatably abutted to the back surface of relatively thin portion 45*c* which is projected from the mounting hole h, thereby the relatively thin portion 45*c* is deformed to form a plasticized portion 45*c*', caulking the needle electrode 45 as shown in FIG. 17(*c*), therefore, the needle electrode 45 is no longer removed therefrom.

According to the second embodiment of the present invention, the junction of the needle electrode 45 and deflection electrode 29 is secured by the caulking work, enhancing impact resistance, thermal resistance and durability of the apparatus.

Third Embodiment

Figure 18A:
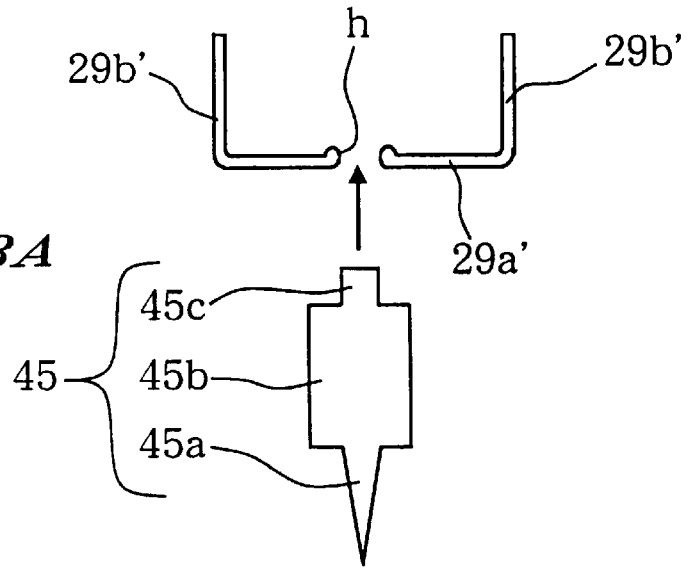
FIGS. 18(*a*) to 18(*c*) are explanatory views showing a method of fabricating the needle electrode to the deflection electrode in a third embodiment of the present invention.
Figure 18B:
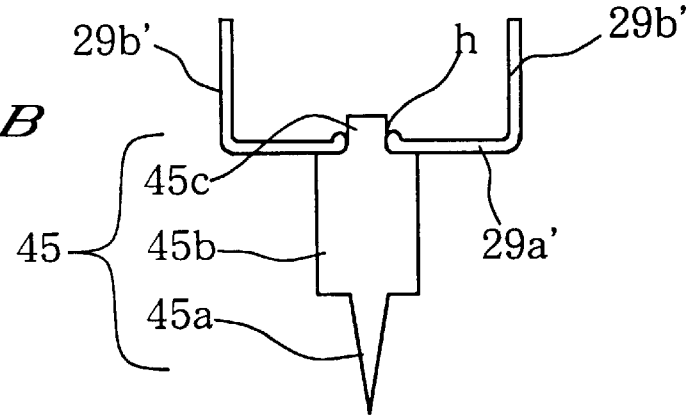
Figure 18C:
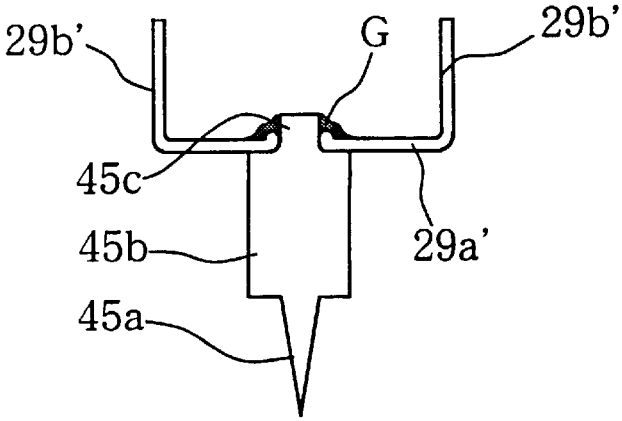

A third embodiment of the present invention will be described with the reference to FIGS. 18(*a*) to 18(*c*). FIGS. 18(*a*) to 18(*c*) are diagrammatical explanatory views showing a method of mounting the needle electrode 45 on the deflection electrode 29.

The third embodiment different from the second embodiment is that the needle electrode 45 is fixed with the brazing work instead of the caulking work, as shown in FIGS. 18(*a*) to 18(*c*).

Detailed descriptions of the step in manufacturing are omitted since the mostly same method in the second embodiment is involved in this embodiment. Therefore, the same reference numerals are designated on FIGS. 18(*a*) to 18(*c*) as those used on FIGS. 17(*a*) to 17(*c*).

The needle electrode 45 is fixed lo the front plate 29*a*' by the brazing work, enhancing uniformity of the junction quality and stabilization of dust collection. The needle electrode 45 is fixed to the middle processed portion 34, but may be fixed to a complete unit shown in FIGS. 6 to 9, for example.

Fourth Embodiment

Figure 19:
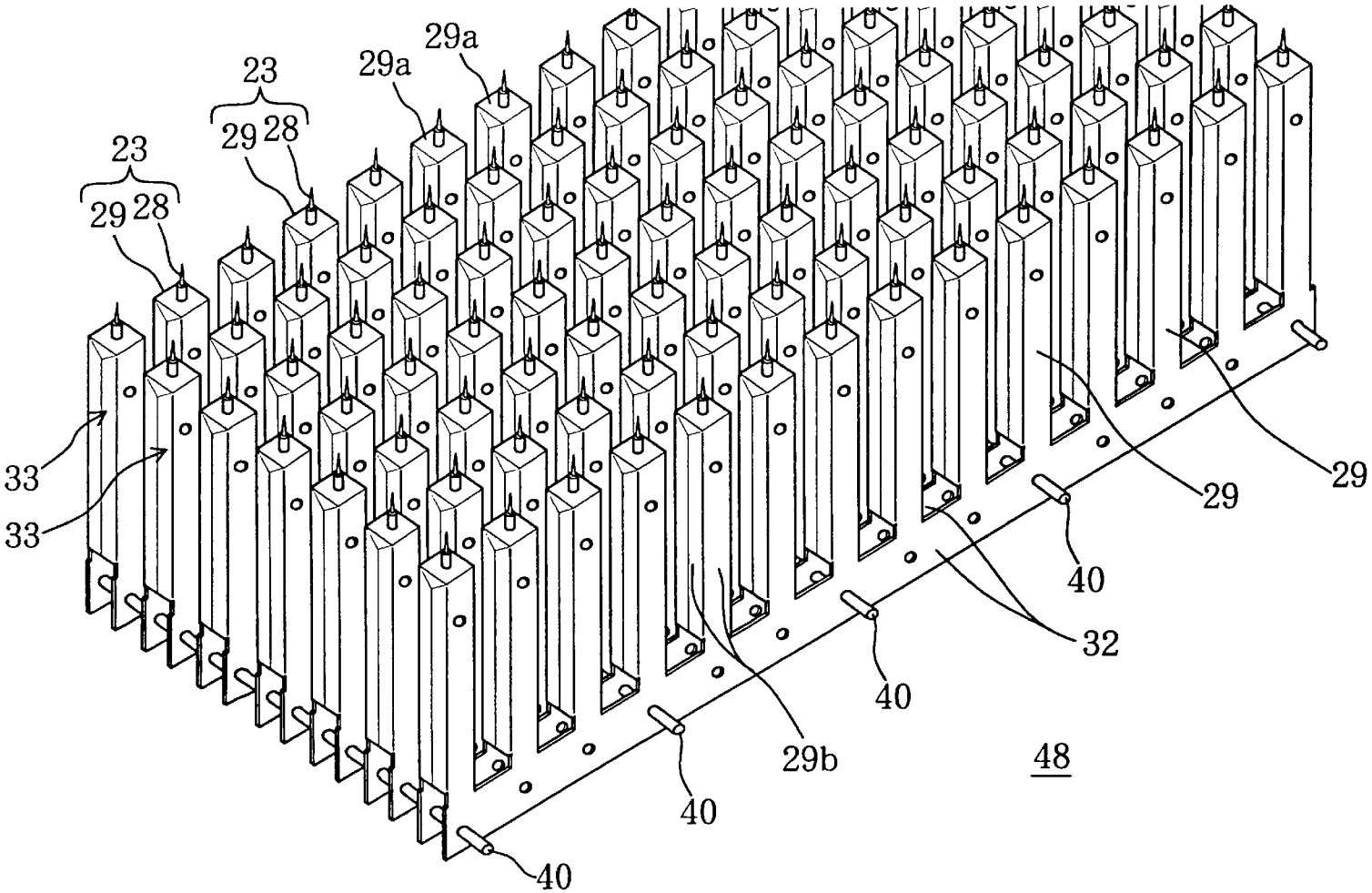
FIG. 19 is a perspective view showing a structure of male-type sub-unit in a fourth embodiment of the present invention.

A fourth embodiment of the present invention will be described next. FIG. 19 is a perspective view showing a male-type subunit body 48.

The fourth embodiment is different from the third embodiment in that electrical and mechanical couplings between the needle deflection coupled electrodes 33, 33, . . . are realized only with the rod coupling members 40, 40, . . . instead of using the comb-type coupling members 39, 39, . . . in manufacturing process of the male-type sub-unit 48, referring to FIG. 8 which is previously described, so that the electrical and mechanical couplings can be obtained from only penetrating the rod coupling members 40, 40, . . . into the penetrating holes p, p, . . . formed on the connecting portions 32, 32, making fabrication work simple and reducing the number of processes. The comb-type coupling members 39, 39, . . . may also be used for realizing the electrical and mechanical coupling instead of using the rod coupling members 40, 40, . . .

Fifth Embodiment

Figure 20:
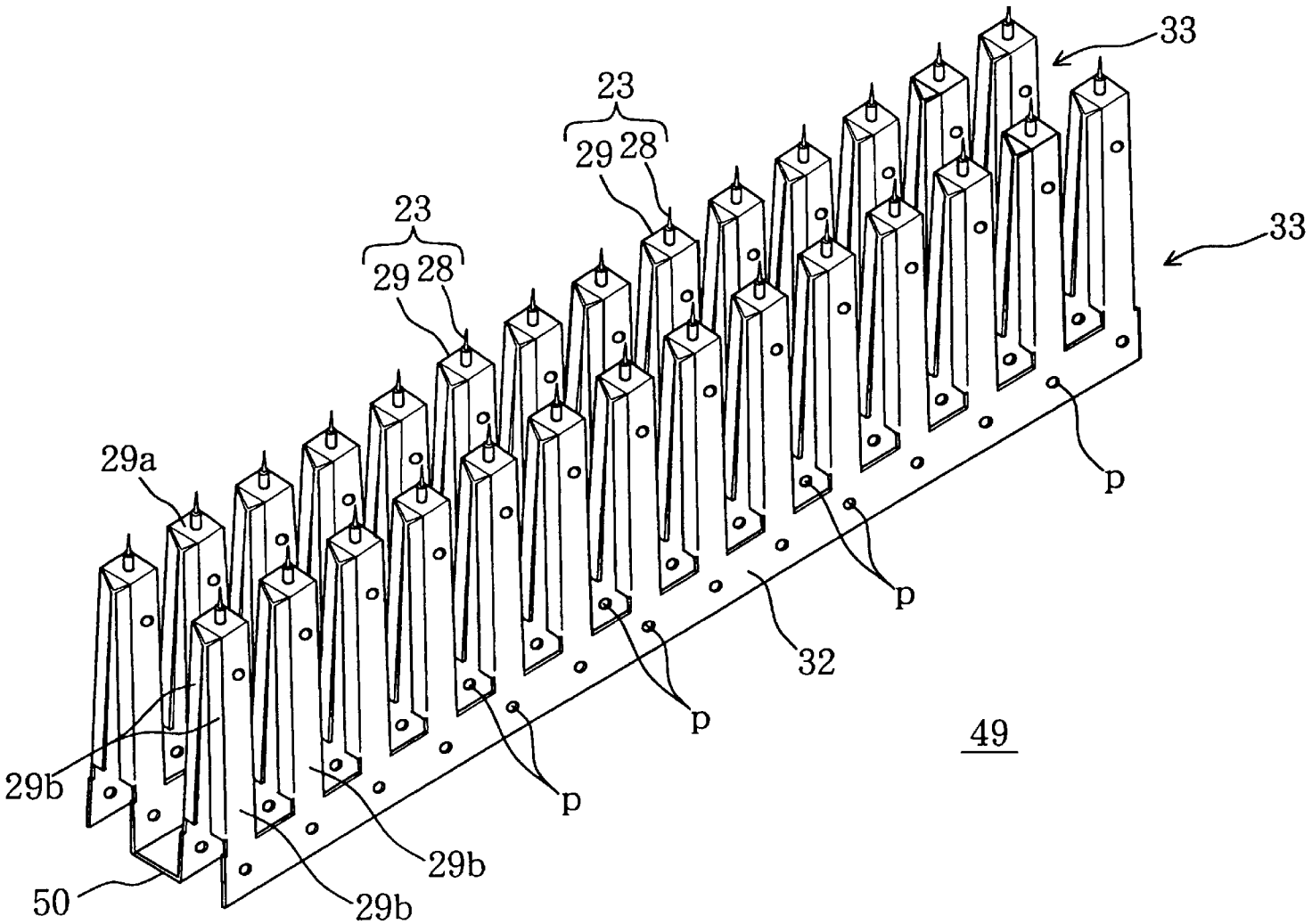
FIG. 20 is a perspective view showing a structure of the needle deflection coupled electrodes in a fifth embodiment of the present invention.

A fifth embodiment of the present invention will be described next. FIG. 20 is a perspective view showing a two-column arrangement of needle deflection coupled electrode 49. The two-column of needle deflection coupled electrode 49 comprises two of needle deflection coupled electrodes 33, 33 (FIG. 6) coupled by a column coupling piece 50, each of the needle deflection coupled electrodes 33, 33 is formed by punching and bending up a single sheet metal, as described in the first embodiment.

M (integer of 3 or more) number of needle deflection coupled electrodes 33, 33, . . . may be coupled by M+1 number of column coupling pieces 50, 50, . . . , making a multi-column arrangement in one unit.

Sixth Embodiment

Figure 21:
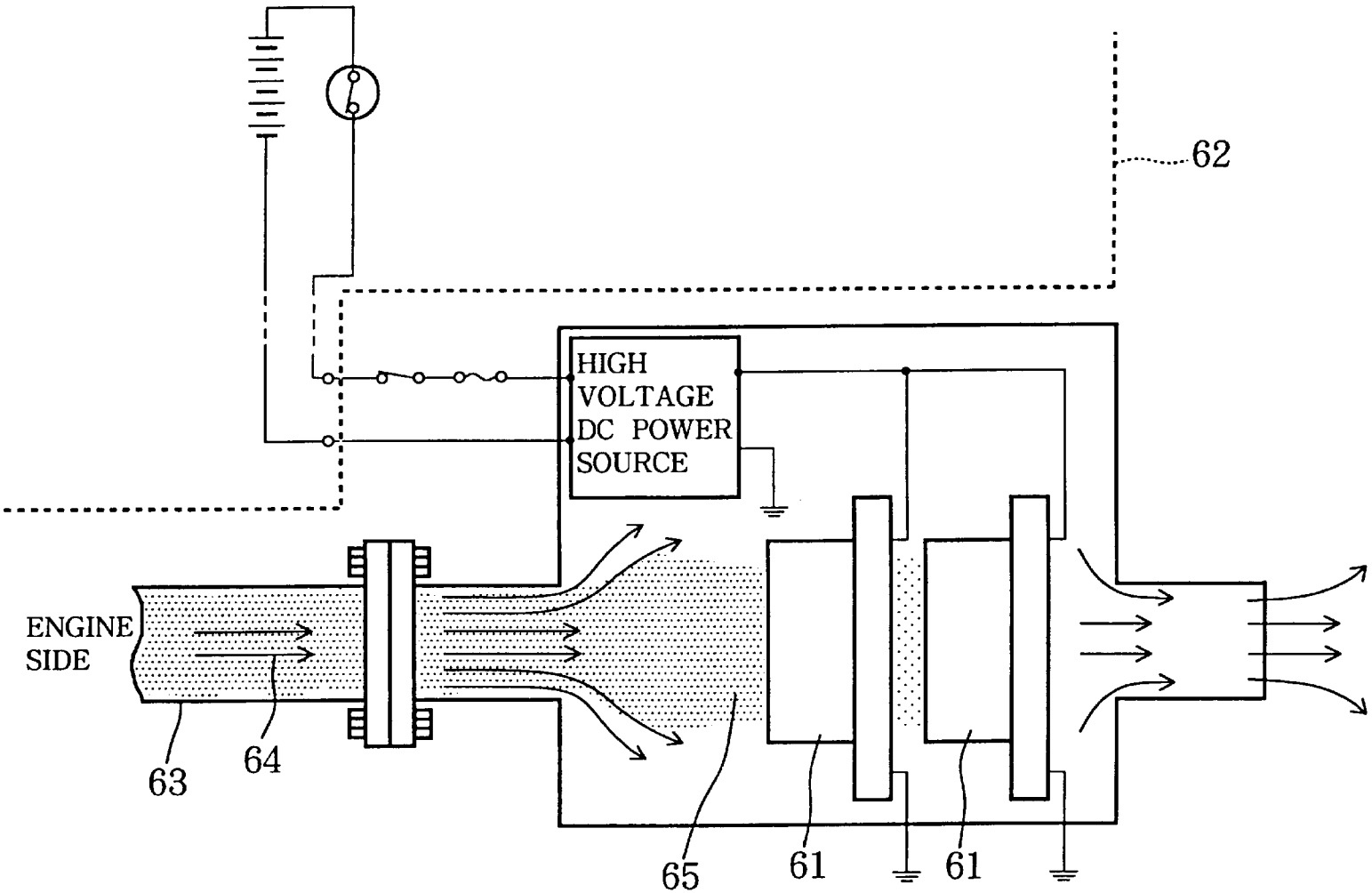
FIG. 21 is a diagrammatic sectional view showing a structure of a black smoke removing apparatus for Diesel engine's exhaust in a sixth embodiment of the present invention.
Figure 22:
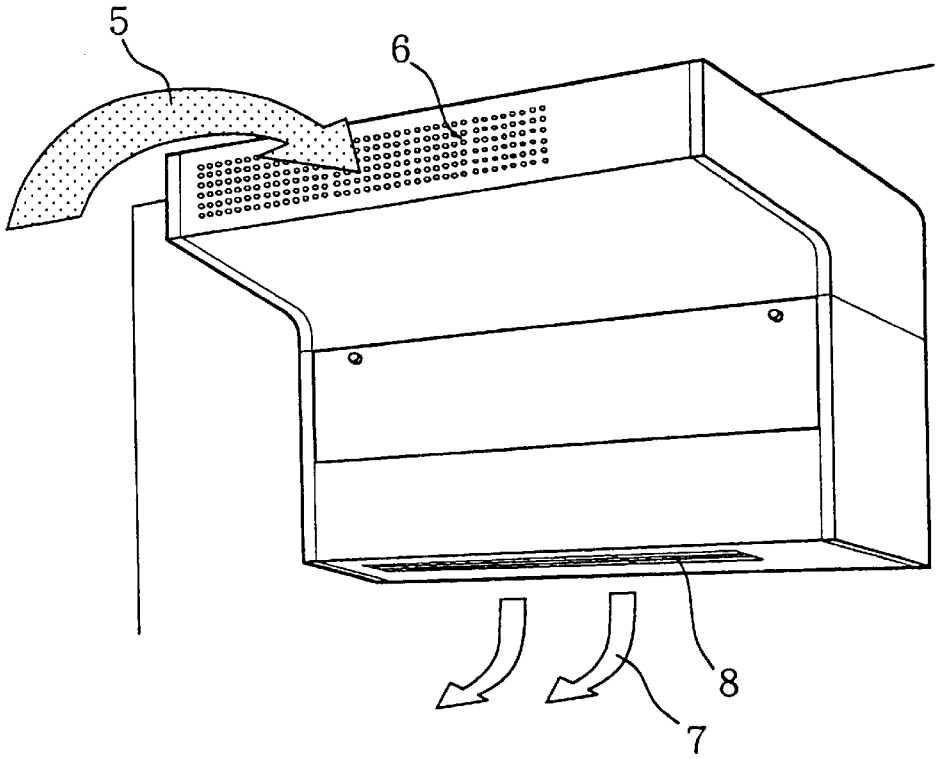
FIG. 22 PRIOR ART
FIG. 22 is a perspective view showing an air cleaner for explaining a related art device.
Figure 23:
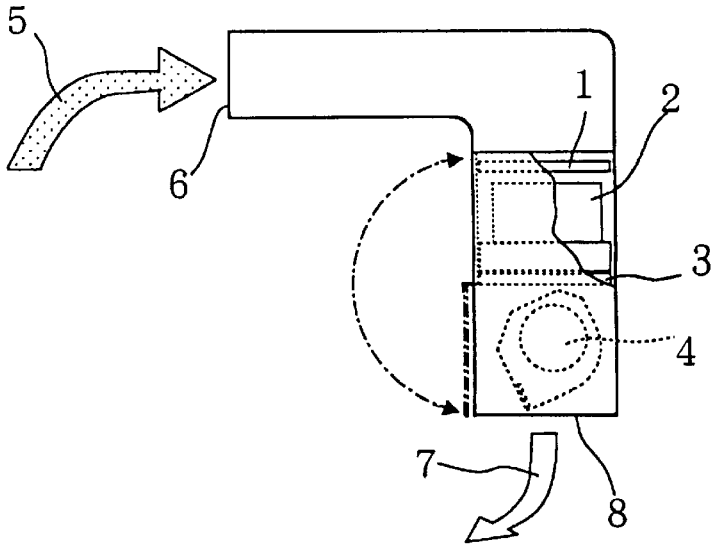
FIG. 23 PRIOR ART
FIG. 23 is a side view, partially cut away, of showing the air cleaner.
Figure 24:
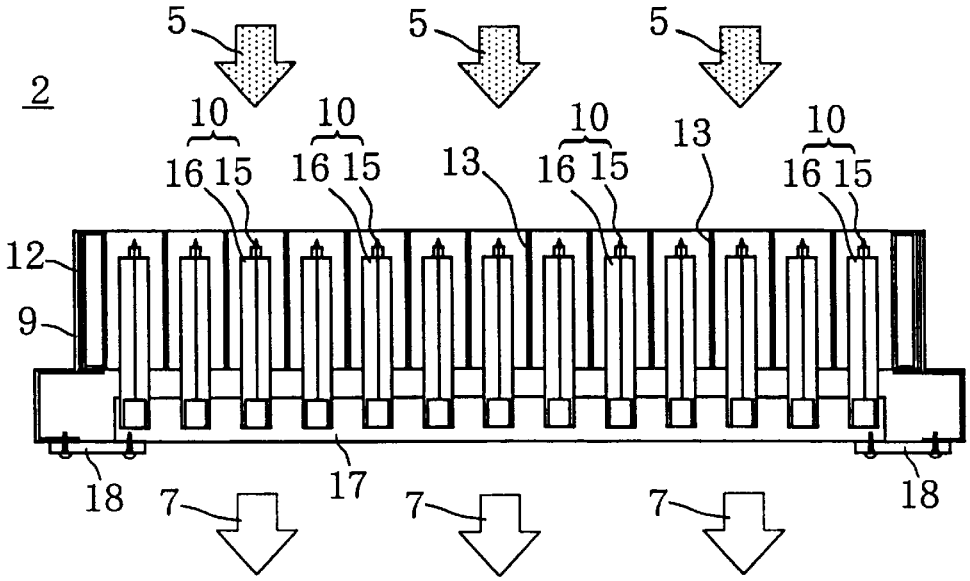
FIG. 24 PRIOR ART
FIG. 24 is a vertically sectional view showing a structure of the dust collecting unit of major part of the air cleaner.
Figure 25:
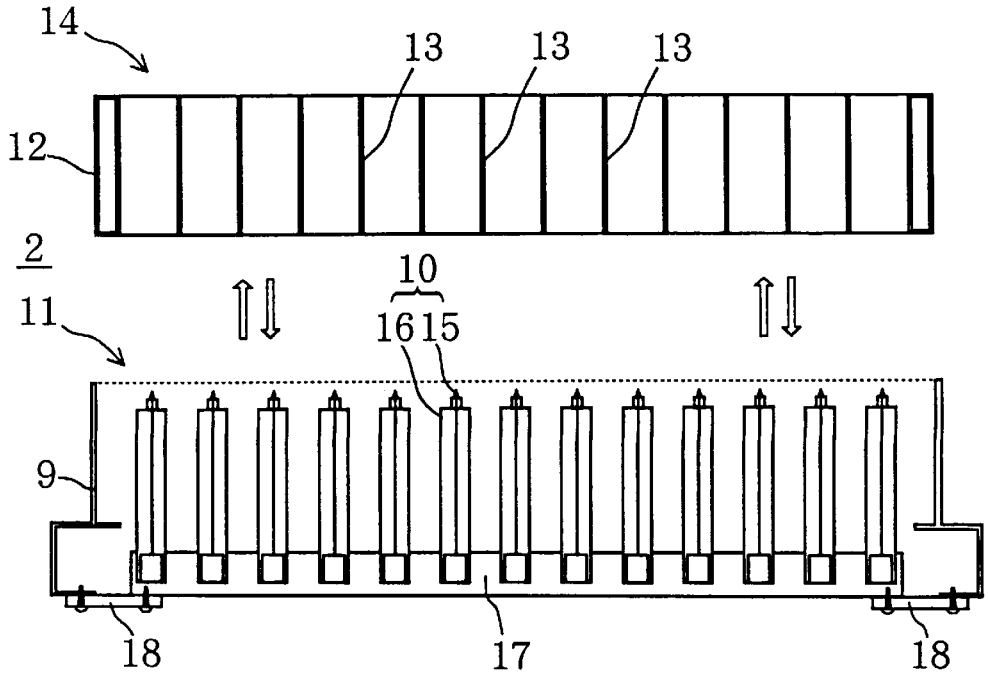
FIG. 25 PRIOR ART
FIG. 25 is a vertically sectional view showing a male-type sub-unit and a female-type sub-unit of the duct collecting unit.

A sixth embodiment of the present invention will be described next. FIG. 21 is a diagrammatic sectional view showing a structure of a black smoke removing apparatus for Diesel engine's exhaust.

The black smoke removing apparatus comprises two dust collecting units 21, 21 mounted on an exhaust pipe 63 of a Diesel engine operated vehicle to collect a black smoke 65 in an exhaust 64, each of the dust collecting units 21, 21 is already described in the previously explained embodiments as to how they are produced and fabricated.

In the case of this embodiment, the needle electrode 45 should desirably be fixed to the front plate 29*a*' by either the impact or the caulking work to ensure thermal resistance and durability.

According to the embodiments described above, the number of needle deflection coupled electrodes 23, columns of needle deflection coupled electrodes 33, comb-type coupling members 39, and collector cells 26 may be changed in accordance with the scale of the apparatus. The shape of the columns of needle deflection coupled electrodes 33 may be changed to an application depending on size and design. A single needle deflection coupled electrode 23 may be produced by punching and bending a single sheet of metal. The shape of needle deflection coupled electrode 23 may be made not only a rectangularly hollow longitudinal structure but also a triangularly hollow longitudinal structure. A hammer machine may be used for caulking the relatively thin portion 45*c* instead of using the high speed eccentric caulking machine 46. The dust collecting unit 21 may be used for not only the black smoke removing apparatus, but also used for an oil-mist removing apparatus and an electrical dust collecting apparatus in a factory.

It is thus apparent that the present invention is not limited to the above embodiments but may be changed and modified without departing from the scope and spirit of the invention.

Finally, the present application claims the priority of Japanese Patent Application No. Hei 9-70493 filed Mar. 7, 1997, the disclosure of which is herein incorporated by reference.

What is claimed is:

1. An electric dust collecting apparatus comprising:

at least one needle electrode configured to charge floating particles in air by generating corona discharge around needle points;

at least one collecting electrode provided on cell arrangement corresponding to the needle electrodes and configured to attract and collect the charged floating particles by an electrostatic force; and at least one deflection electrode comprising a continuous sheet of metal having a front plate portion with a mounting hole therein, a plurality of side plate portions, said sheet of metal being bent such that said plurality of side plate portions are substantially perpendicular to said face portion and edges of said plurality of side plate portions become adjacent to one another so as to form a rectangularly hollow longitudinal structure, said needle electrode being fixed in said mounting hole;

wherein said deflection electrode applies a deflection force to the charged floating particles to move said charged floating particles toward the collecting electrodes by a potential applied from the side plate portions.

2. An electric dust collecting apparatus according to claim 1, wherein each needle electrode comprises a needle portion and a body portion, and each body portion is engaged and tightly fixed to a respective needle electrode mounting hole with the needle electrode projected from the front plate portion.

3. An electric dust collecting apparatus according to claim 1, wherein the needle electrodes is inserted into the needle electrode mounting hole from an outside of the front plate portion and caulked from an inside of the front plate portion.

4. An electric dust collecting apparatus comprising:

a plurality of needle electrodes configured to charge floating particles in air by generating corona discharge around needle points;

a plurality of cell collecting electrodes provided in correspondence with the respective needle electrodes, and configured to attract and collect the charged floating particles by an electrostatic force; and a plurality of deflection electrodes each comprising a continuous sheet of metal having a front plate portion with a mounting hole therein, a plurality of side plate portions, said sheet of metal being bent such that said plurality of side plate portions are substantially perpendicular to said face portion and edges of said plurality of side plate portions become adjacent to one another so as to form a rectangularly hollow longitudinal structure, said needle electrode being fixed in said mounting hole;

wherein each of said deflection electrodes applies a deflection force to the charged floating particles to move toward the collecting electrodes by a potential applied from the side plate portions, the plurality of deflection electrodes are grouped into units, each of the units having N (integer of 2 or greater) number of deflection electrodes coupled with a first connecting portion therebetween; and the rectangularly hollow longitudinal structures are arranged in a three-dimensional integrated piece.

5. An electric dust collecting apparatus according to claim 4, wherein the rectangularly hollow longitudinal structures are arranged in series in the three-dimensional integrated piece.

6. An electric dust collecting apparatus according to claim 5, wherein two of said first connecting portions are opposite to each other after bending, and the rectangularly hollow longitudinal structures have a predetermined interval and are arranged in series in the three-dimensional integrated piece.

7. An electric dust collecting apparatus according to claim 6, wherein bottom parts of the units of group electrodes are mechanically and electrically coupled together with a plurality of comb coupling members; and the plurality of comb coupling members are mechanically and electrically engaged with the pair of second connecting portions.

8. An electric dust collecting apparatus according to claim 6, wherein the units of group electrodes are mechanically and electrically coupled by rod coupling members penetrated into coupling holes formed on the first connecting portions with a predetermined interval, thereby fix the plurality of group electrodes together by the rod coupling members in a complete piece.

9. An electric dust collecting apparatus according to claim 6, wherein the needle electrodes are arranged on substantially central positions on each of the front plate portions of the deflection electrodes in alignment.

10. An electric dust collecting apparatus according to claim 4, wherein the M (integer of 2 or greater) number of said units having the N number of deflection electrodes are provided and coupled to each other through second connecting portions, thus M times N number of deflection electrodes are provided as said plurality of deflection electrodes.

11. An electric dust collecting apparatus according to claim 4, wherein the needle electrodes is inserted into the needle electrode mounting hole from an outside of the front plate portion and fixed to the front plate portion by a brazing joint.

12. An electric dust collecting apparatus comprising:

a plurality of deflection electrodes each having a needle electrode configured to charge floating particles in air by generating corona discharge around needle points;

a collecting electrode provided on cell arrangement corresponding to the needle electrodes, and configured to attract and collect the charged floating particles by electrostatic force; and the deflection electrode comprising a continuous sheet of metal having a front plate portion with a mounting hole therein, a plurality of side plate portions, said sheet of metal being bent such that said plurality of side plate portions are substantially perpendicular to said face portion and edges of said plurality of side plate portions become adjacent to one another so as to form a rectangularly hollow longitudinal structure, and a needle electrode fixed in said hole, wherein said deflection electrode applies a deflection force to the charged floating particles to move toward the collecting electrodes by a potential applied from the side plate portions, the needle electrode is made up of a stainless steel, and a needle portion thereof is applied by a nickel plating of 2 to 10 $\mu$m thick.

13. A method of manufacturing an electric dust collecting apparatus including: at least one needle electrode for charging floating particles in the air by generating a corona discharge around a needle point of the needle electrode; at least one collecting electrode provided in a cell arrangement corresponding to the needle electrode, the collecting electrode attracting and collecting the charged floating particles by an electrostatic force; and at least one deflection electrode having a rectangularly hollow longitudinal structure comprised of a front plate portion and side plate portions, wherein the needle electrode is fixed to the front plate portion, the deflection electrode applying a deflection force to the charged floating particles to move the particles to the collecting electrode under the influence of a potential of the side plate portions, the method comprising the steps of:

applying a punch press process to a sheet metal to obtain a profile plate for forming the rectangularly hollow longitudinal structure; and bending the profile plate in a longitudinal direction of the plate to form the side plate portions and the front plate portion of the rectangularly hollow longitudinal structure, thereby forming the at least one deflection electrode.

14. A method of manufacturing an electric dust collecting apparatus including a plurality of needle electrodes for charging floating particles in the air by generating a corona discharge around each of needle points of the needle electrodes; a plurality of cell-shaped collecting electrodes corresponding to the needle electrodes, the collecting electrodes attracting and collecting the charged floating particles by an electrostatic force; and a plurality of deflection electrodes each having a rectangularly hollow longitudinal structure comprised of a front plate portion and side plate portions, wherein each of the needle electrodes is fixed to the front plate portion, applying a deflection force to the charged floating particles to move the particles to the collecting electrode under the influence of a potential of the side plate portions, the method comprising the steps of:

determining a predetermined number of the deflection electrodes provided in at least one unit, wherein N (an integer of 2 or more) is the number of the deflection electrodes of the unit each having the rectangularly hollow longitudinal structure coupled with a connecting portion therebetween;

punching a sheet metal to form a profile plate of the rectangularly hollow longitudinal structures; and bending the profile plate to form the rectangularly hollow longitudinal structures each having the side plate portions and the front plate portion both formed by the step of punching, thereby forming the rectangularly hollow longitudinal structures into a three-dimensional integrated piece.

15. A method according to claim 14, wherein the profile plate is bent to to form a series of the rectangularly hollow longitudinal structures; and, each of the structures having the side plate portions and the front plate portion coupled with the connecting portions therebetween; whereby the deflection electrodes each having the rectangularly hollow longitudinal structure are formed into the three-dimensional integrated piece.

16. A method according to claim 14, further comprising determining M number of said units having the N number of deflection electrodes to be provided; and coupling said units together using second connecting portions, thus M (integer of 2 or greater) times N number of the deflection electrodes are provided as said plurality of deflection electrodes.

17. A method of manufacturing an electric dust collecting apparatus including: a plurality of needle electrodes for charging floating particles in the air by generating a corona discharge around each of needle points of the needle electrodes; a plurality of cell-shaped collecting electrodes corresponding to the needle electrodes, each of the collecting electrodes attracting and collecting the charged floating particles by an electrostatic force; and a plurality of deflection electrodes each having a rectangularly hollow longitudinal structure comprised of a front plate portion and side plate portions, wherein each of the needle electrodes is fixed to the front plate portion, the deflection electrode applying a deflection force to the charged floating particles to move the particles to the collecting electrode under the influence of a potential of the side plate portions, the method comprising the steps of:

providing needle electrodes, each having a needle portion and a body portion;

applying a punch press process to a sheet metal to form a profile plate for forming at least one of the deflection electrodes;

providing a needle mounting hole at a substantially central portion of the front plate portion, a diameter of which hole is smaller than that of the body portion;

inserting the needle electrode into the needle electrode mounting hole by applying an impact to the needle electrode from back of the front plate; and bending the profile plate in its longitudinal direction to form the deflection electrode;

whereby the needle portion of the needle electrode is projected from the front plate portion and the body portion of the needle electrode is tightly fixed to the needle electrode mounting hole.

18. A method according to claim 17, wherein the deflection electrodes are coupled with a connecting portion, and a comb-shaped coupling member is mechanically and electrically engaged with a pair of the connecting portion.

19. A method according to claim 17, wherein the deflection electrodes are coupled with a connecting portion, and the deflection electrodes are mechanically and electrically coupled by rod coupling members mounted in a coupling hole formed in the connecting portion at predetermined intervals, and whereby a plurality of the deflection electrodes are fixed by the rod coupling member to form a three-dimensional integrated piece.

* * * * *